US012378033B2

(12) United States Patent
Nowak et al.

(10) Patent No.: US 12,378,033 B2
(45) Date of Patent: Aug. 5, 2025

(54) TRAY FOR FOOD PRODUCTS

(71) Applicant: Graphic Packaging International, LLC, Atlanta, GA (US)

(72) Inventors: Lee Nowak, Leicestershire (GB); Elliot Hithersay, Derbyshire (GB)

(73) Assignee: Graphic Packaging International, LLC, Atlanta, GA (US)

( * ) Notice: Subject to any disclaimer, the term of this patent is extended or adjusted under 35 U.S.C. 154(b) by 65 days.

(21) Appl. No.: 18/144,312

(22) Filed: May 8, 2023

(65) Prior Publication Data

US 2023/0356876 A1 Nov. 9, 2023

Related U.S. Application Data

(60) Provisional application No. 63/339,628, filed on May 9, 2022, provisional application No. 63/341,711, filed on May 13, 2022.

(51) Int. Cl.
*B65D 5/00* (2006.01)
*B65D 5/18* (2006.01)

(52) U.S. Cl.
CPC ..... *B65D 5/18* (2013.01)

(58) Field of Classification Search
CPC ..... B65D 5/18; B65D 5/56
USPC ..... 206/557
See application file for complete search history.

(56) References Cited

U.S. PATENT DOCUMENTS 2,110,681 A 3/1938 Rutledge
3,104,012 A 9/1963 Beamish
3,154,215 A 10/1964 Le Vesconte
3,358,900 A 12/1967 Perdue et al.
3,489,331 A 1/1970 Andersson et al.
3,575,338 A 4/1971 Dilot
3,640,188 A 2/1972 Dilot
3,893,882 A 7/1975 Repenning
3,941,301 A 3/1976 Jorgensen
4,046,310 A 9/1977 Gustafsson
4,057,380 A 11/1977 Hosoe
(Continued)

FOREIGN PATENT DOCUMENTS

CA 2 814 149 A1 4/2012
CN 203450620 U 2/2014
(Continued)

OTHER PUBLICATIONS

International Search Report and Written Opinion for PCT/US2023/021302 dated Aug. 29, 2023.

*Primary Examiner* — Steven A. Reynolds
(74) *Attorney, Agent, or Firm* — FisherBroyles, LLP

(57) ABSTRACT

A tray for holding at least one food product, the tray having a plurality of panels extending at least partially around an interior of the tray and including a bottom panel, a front panel foldably connected to the bottom panel, a back panel foldably connected to the bottom panel, and a top panel foldably connected to one of the front panel and the back panel. The tray further includes a plurality of end flaps foldably connected to a respective panel of the plurality of panels, the plurality of end flaps at least partially overlapped to form at least one closed end of the tray, and a flange comprising the top panel, the flange extending outwardly from the front panel, the back panel, and the at least one closed end of the tray.

29 Claims, 20 Drawing Sheets

(56) References Cited

U.S. PATENT DOCUMENTS

| | | | | |
|---|---|---|---|---|
| 4,130,236 | A | 12/1978 | Manizza | |
| 4,166,567 | A * | 9/1979 | Beach, Jr. | B65D 5/56 229/125.21 |
| 4,283,427 | A | 8/1981 | Winters et al. | |
| 4,285,461 | A * | 8/1981 | Meyers | B65D 77/2076 229/207 |
| 4,305,542 | A | 12/1981 | Benzschawel et al. | |
| 4,308,985 | A | 1/1982 | Manizza | |
| 4,325,905 | A | 4/1982 | Takahashi | |
| 4,351,473 | A | 9/1982 | Manizza | |
| 4,533,065 | A | 8/1985 | Chazal et al. | |
| 4,555,381 | A | 11/1985 | Chazal et al. | |
| 4,718,596 | A | 1/1988 | Muller et al. | |
| 4,871,111 | A | 10/1989 | Mode | |
| 4,943,456 | A | 7/1990 | Pollart et al. | |
| 5,000,374 | A | 3/1991 | Deiger | |
| 5,002,826 | A | 3/1991 | Pollart et al. | |
| 5,002,833 | A | 3/1991 | Kinsey, Jr. et al. | |
| 5,118,747 | A | 6/1992 | Pollart et al. | |
| 5,203,491 | A | 4/1993 | Marx et al. | |
| 5,253,801 | A | 10/1993 | Bernstein et al. | |
| 5,326,021 | A | 7/1994 | Farrell | |
| 5,351,879 | A | 10/1994 | Liu | |
| 5,410,135 | A | 4/1995 | Pollart et al. | |
| 5,412,187 | A | 5/1995 | Walters et al. | |
| 5,530,231 | A | 6/1996 | Walters et al. | |
| 5,533,622 | A | 7/1996 | Stockley, III | |
| 5,533,623 | A | 7/1996 | Fischer | |
| 5,647,168 | A | 7/1997 | Gilbert | |
| 6,092,687 | A | 7/2000 | Hupp et al. | |
| 6,092,719 | A | 7/2000 | Capo | |
| 6,116,501 | A | 9/2000 | Hupp | |
| 6,204,492 | B1 | 3/2001 | Zeng et al. | |
| 6,234,386 | B1 | 5/2001 | Drummond et al. | |
| 6,433,322 | B2 | 8/2002 | Zeng et al. | |
| 6,552,315 | B2 | 4/2003 | Zeng et al. | |
| 6,677,563 | B2 | 1/2004 | Lai | |
| 8,002,171 | B2 | 8/2011 | Ryan et al. | |
| 8,006,893 | B2 | 8/2011 | Burke et al. | |
| 8,087,527 | B2 | 1/2012 | Johnson | |
| 8,365,920 | B2 | 2/2013 | House et al. | |
| 8,444,902 | B2 | 5/2013 | Middleton et al. | |
| 8,534,460 | B2 | 9/2013 | Wnek et al. | |
| 8,740,050 | B2 | 6/2014 | Zinck et al. | |
| 8,741,443 | B2 | 6/2014 | Hilbish | |
| 8,801,995 | B2 | 8/2014 | Wnek et al. | |
| 8,858,858 | B2 | 10/2014 | Middleton et al. | |
| 9,132,612 | B2 | 9/2015 | Bohrer | |
| 9,320,373 | B2 | 4/2016 | Burke et al. | |
| 9,783,345 | B2 * | 10/2017 | Bentham | B65D 5/4266 |
| 10,053,259 | B2 | 8/2018 | Gungner | |
| 10,077,134 | B2 | 9/2018 | Wnek et al. | |
| 10,086,972 | B2 * | 10/2018 | Hajek | B65D 5/0085 |
| 11,084,626 | B2 | 8/2021 | Gilpatrick et al. | |
| 11,167,518 | B2 | 11/2021 | O'Hagan et al. | |
| 11,358,779 | B2 | 6/2022 | Tye | |
| D957,247 | S | 7/2022 | Bevier | |
| 11,434,038 | B2 | 9/2022 | Tye et al. | |
| 11,554,569 | B2 | 1/2023 | Wnek | |
| 2005/0031814 | A1 | 2/2005 | Dawes | |
| 2005/0051461 | A1 | 3/2005 | Bryant | |
| 2007/0116806 | A1 | 5/2007 | Parsons | |
| 2008/0035634 | A1 | 2/2008 | Zeng et al. | |
| 2011/0174676 | A1 | 7/2011 | Stockhaus | |
| 2011/0259784 | A1 | 10/2011 | Tye et al. | |
| 2012/0248180 | A1 | 10/2012 | White et al. | |
| 2013/0327821 | A1 | 12/2013 | Zwaga et al. | |
| 2014/0054300 | A1 | 2/2014 | Gilpatrick et al. | |
| 2014/0183198 | A1 | 7/2014 | Slack | |
| 2014/0224866 | A1 | 8/2014 | Littlejohn et al. | |
| 2015/0225120 | A1 | 8/2015 | Wnek et al. | |
| 2017/0166384 | A1 | 6/2017 | Walsh et al. | |
| 2017/0341355 | A1 | 11/2017 | Peiffer et al. | |
| 2018/0022529 | A1 | 1/2018 | Tye | |
| 2018/0319568 | A1 | 11/2018 | Tye | |
| 2020/0047940 | A1 | 2/2020 | Tye et al. | |
| 2020/0047975 | A1 * | 2/2020 | Tye | B65D 5/4266 |
| 2020/0255200 | A1 | 8/2020 | Mondini et al. | |
| 2021/0053720 | A1 * | 2/2021 | Page | B65D 5/4204 |
| 2023/0294896 | A1 * | 9/2023 | Jackson | B65D 77/2024 206/514 |

FOREIGN PATENT DOCUMENTS

| | | | |
|---|---|---|---|
| DE | 100 22 552 | | 11/2001 |
| EP | 0 671 332 | A1 | 9/1995 |
| EP | 1 104 744 | A2 | 6/2001 |
| FR | 2 133 727 | | 12/1972 |
| FR | 2406522 | | 5/1979 |
| FR | 2826938 | | 1/2003 |
| FR | 2933329 | | 1/2010 |
| GB | 1 314 148 | | 4/1973 |
| GB | 1 501 764 | | 2/1978 |
| GB | 1 602 625 | | 11/1981 |
| GB | 2 487 765 | A | 8/2012 |
| GB | 2 550 386 | A | 11/2017 |
| JP | 2000-141511 | | 5/2000 |
| JP | 2001 278246 | A | 10/2001 |
| JP | 2002 347746 | A | 12/2002 |
| KR | 10-1539187 | B1 | 7/2015 |
| TW | M 295475 | U | 8/2006 |
| TW | M 301016 | U | 11/2006 |
| WO | WO 2003/041945 | | 5/2003 |
| WO | WO 2007/127371 | | 11/2007 |
| WO | WO 2009/138786 | | 11/2009 |
| WO | WO 2010 033250 | A1 | 3/2010 |
| WO | WO 2012/049005 | | 4/2012 |
| WO | WO 2013/002639 | | 1/2013 |
| WO | WO 2014/032059 | A1 | 2/2014 |
| WO | WO 2014/066867 | A1 | 5/2014 |
| WO | WO 2015/009518 | | 1/2015 |
| WO | WO 2018/017783 | | 1/2018 |
| WO | WO 2018/178508 | A1 | 10/2018 |
| WO | WO 2019/020863 | | 1/2019 |
| WO | WO 2019/092323 | A1 | 5/2019 |
| WO | WO 2019/094057 | A1 | 5/2019 |
| WO | WO 2020/033350 | | 2/2020 |
| WO | WO 2020/033352 | | 2/2020 |

* cited by examiner

TRAY FOR FOOD PRODUCTS

CROSS-REFERENCE TO RELATED APPLICATIONS

This application claims the benefit of each of U.S. Provisional Patent Application No. 63/339,628, filed on May 9, 2022, and U.S. Provisional Patent Application No. 63/341,711, filed on May 13, 2022.

INCORPORATION BY REFERENCE

The disclosures of each of U.S. Design patent application Ser. No. 29/891,539, filed on May 8, 2023, U.S. Design patent application Ser. No. 29/891,540, filed on May 8, 2023, U.S. Provisional Patent Application No. 63/110,578, filed on Nov. 6, 2020, U.S. Provisional Patent Application No. 63/110,582, filed on Nov. 6, 2020, U.S. Provisional Patent Application No. 63/110,587, filed on Nov. 6, 2020, U.S. Provisional Patent Application No. 63/126,157, filed on Dec. 16, 2020, U.S. Provisional Patent Application No. 63/128,418, filed on Dec. 21, 2020, U.S. Provisional Patent Application No. 63/139,341, filed on Jan. 20, 2021, U.S. Provisional Patent Application No. 63/169,302, filed on Apr. 1, 2021, U.S. Provisional Patent Application No. 63/169,418, filed on Apr. 1, 2021, U.S. Provisional Patent Application No. 63/174,724, filed on Apr. 14, 2021, U.S. Provisional Patent Application No. 63/178,116, filed on Apr. 22, 2021, U.S. Provisional Patent Application No. 63/191,412, filed on Jun. 1, 2021, U.S. patent application Ser. No. 17/519,080, filed on Nov. 4, 2021, U.S. patent application Ser. No. 17/519,084, filed on Nov. 4, 2021, U.S. patent application Ser. No. 17/519,092, filed on Nov. 4, 2021, U.S. patent application Ser. No. 17/519,097, filed on Nov. 4, 2021, U.S. patent application Ser. No. 17/519,017, filed on Nov. 4, 2022, U.S. Provisional Patent Application No. 63/284,823, filed on Dec. 1, 2021, U.S. Provisional Patent Application No. 63/292,014, filed on Dec. 21, 2021, U.S. Provisional Patent Application No. 63/339,628, filed on May 9, 2022, and U.S. Provisional Patent Application No. 63/341,711, filed on May 13, 2022, are hereby incorporated by reference for all purposes as if presented herein in their entirety.

BACKGROUND OF THE DISCLOSURE

The present disclosure generally relates to trays for holding at least one food product.

SUMMARY OF THE DISCLOSURE

According to one aspect, the disclosure is generally directed to a tray for holding at least one food product, the tray comprising a plurality of panels extending at least partially around an interior of the tray and comprising a bottom panel, a front panel foldably connected to the bottom panel, a back panel foldably connected to the bottom panel, and a top panel foldably connected to one of the front panel and the back panel, a plurality of end flaps foldably connected to a respective panel of the plurality of panels, the plurality of end flaps at least partially overlapped to form at least one closed end of the tray, and a flange comprising the top panel, the flange extending outwardly from the front panel, the back panel, and the at least one closed end of the tray.

According to another aspect, the disclosure is generally directed to a blank for forming a tray for holding at least one food product, the blank comprising a plurality of panels for extending at least partially around an interior of the tray formed from the blank and comprising a bottom panel, a front panel foldably connected to the bottom panel, a back panel foldably connected to the bottom panel, and a top panel foldably connected to one of the front panel and the back panel, a plurality of end flaps foldably connected to a respective panel of the plurality of panels, the plurality of end flaps for being at least partially overlapped to form at least one closed end of the tray formed from the blank, the top panel for forming a flange extending outwardly from the front panel, the back panel, and the at least one closed end of the tray formed from the blank.

According to another aspect, the disclosure is generally directed to a method of forming a tray for holding at least one food product, the method comprising obtaining a blank, the blank comprising a plurality of panels comprising a bottom panel, a front panel foldably connected to the bottom panel, a back panel foldably connected to the bottom panel, and a top panel foldably connected to one of the front panel and the back panel, the blank further comprising a plurality of end flaps foldably connected to a respective panel of the plurality of panels. The method further comprises positioning the plurality of panels extending at least partially around an interior of the tray, at least partially overlapping the plurality of end flaps to form at least one closed end of the tray, and positioning the top panel forming a flange extending outwardly from the front panel, the back panel, and the at least one closed end of the tray formed from the blank.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Trays according to the present disclosure can accommodate articles of numerous different shapes. For the purpose of illustration and not for the purpose of limiting the scope of the disclosure, the following detailed description describes articles such as food products, e.g., fruit or vegetable items. In one embodiment, articles described herein can be fruits such as tomatoes (e.g., cherry tomatoes, etc.), berries (e.g., blueberries, raspberries, blackberries, strawberries, etc.), apples, oranges, tangerines, clementines, lemons, limes, cherries, etc. In another embodiment, articles described herein can be product packages, containers, bottles, cans, etc., that are at least partially disposed within the tray embodiments. The articles can be used for packaging food and beverage products, for example. Packaged articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; composite materials; and the like, or any combination thereof.

The articles described herein can include different types of food or beverage products, containers thereof, and/or having different shapes, without departing from the disclosure. In this specification, the terms "lower," "bottom," "upper," and "top" indicate orientations determined in relation to fully erected and upright trays. As described herein, trays can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

Figure 1:
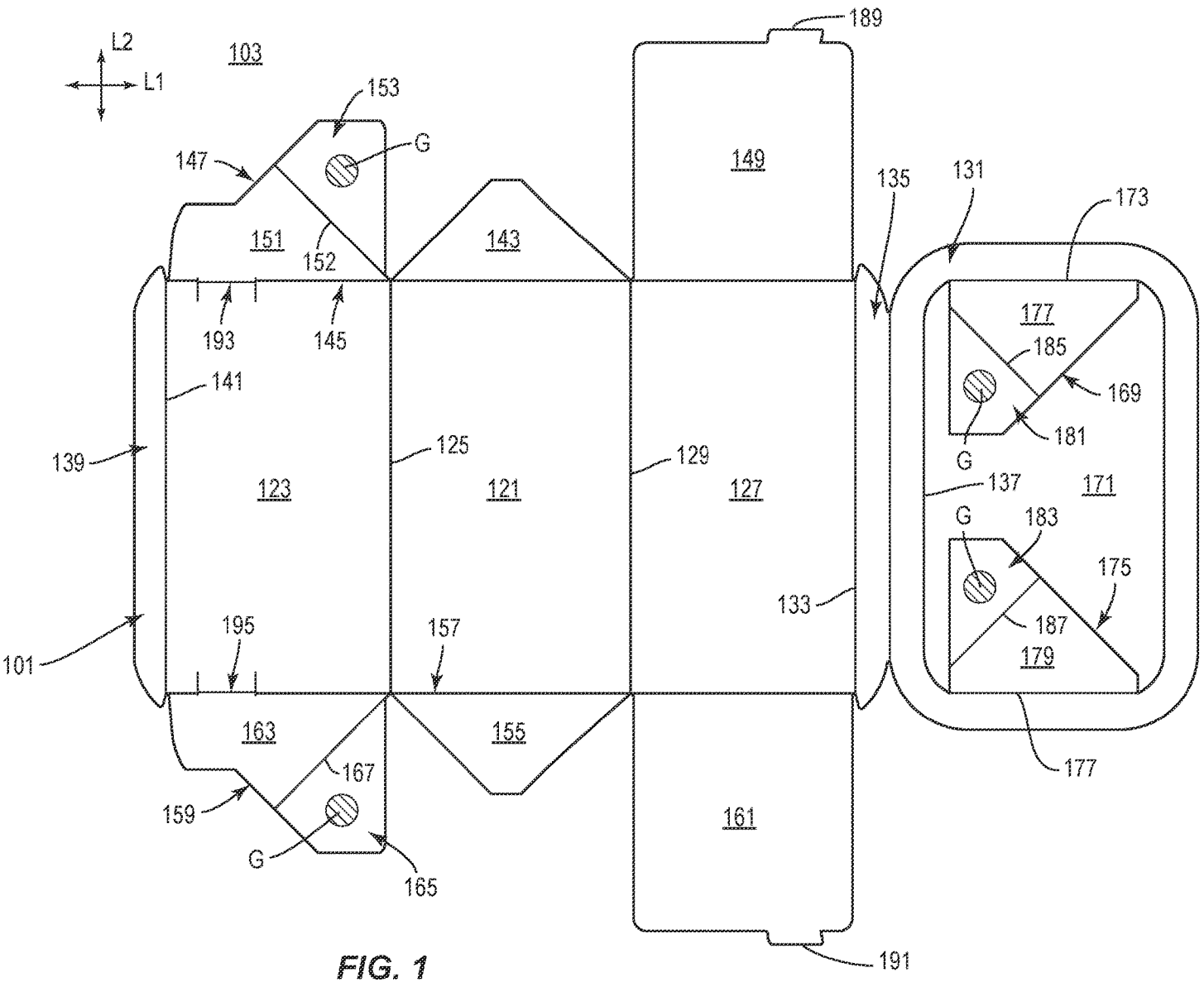
FIG. 1 is a plan view of an exterior surface of a blank used to form a tray according to a first exemplary embodiment of the disclosure.

FIG. 1 is a plan view of an exterior surface 101 of a blank, generally indicated at 103, used to form a container assembly or tray 105 (FIG. 2) according to an exemplary embodiment of the disclosure.

As described further herein, the blank 103 can include engagement features for forming engagement features of the tray 105 that provide one or more surfaces for engaging a machine element or other component of a system associated with the formation, loading, and/or packaging of the tray 105. In addition, the engagement features of the blank 103/tray 105 provide one or more surfaces for receiving a covering or lidding film, e.g., a polymeric film or other cover overlying the tray 105 to maintain one or more conditions of food products held therein.

The blank 103 can also include reinforcement features for forming reinforcement features of the tray 105 that reinforce, e.g., rigidize, stabilize, and/or otherwise minimize, inhibit, prevent, and/or resist deformation of the engagement features. It will be understood that, in some embodiments, one or more of the reinforcement features of the blank 103/tray 105 can be considered part of the engagement features of the tray 105, or vice versa.

As shown, the blank 103 has a longitudinal axis L1 and a lateral axis L2 and includes a plurality of panels for extending at least partially around an interior 107 of the tray 105 when the tray 105 is formed from the blank 103. The panels can include a bottom panel 121, a back panel 123 foldably connected to the bottom panel 121 at a lateral fold line 125, a front panel 127 foldably connected to the bottom panel 121 at a lateral fold line 129, and a top panel 131 (broadly, "first top panel") foldably connected to the front panel 127 at a lateral line of weakening/fold line 133.

As also shown, a first flange support panel 135 can be defined between the fold line 133 and a lateral fold line 137. In some embodiments, the flange support panel 135 can be considered a portion of the top panel 131 such that the top panel 131 is attached to the front panel 127 at the fold line 133. In some embodiments, the top panel 131 can be foldably connected to the support panel 135 at the fold line 137.

Furthermore, a second flange support panel 139 can be foldably connected to the back panel 123 at a lateral line of weakening/fold line 141. In some embodiments, one or both of the flange support panels 135, 139 can be panels of a plurality of panels of the blank 103/tray 105 as described herein. In some embodiments, one or both of the flange support panels 135, 139 can be considered end flaps foldably connected to a respective panel of the plurality of panels of the blank 103/tray 105.

With continued reference to FIG. 1, the blank 103 and tray 105 formed therefrom can further include a plurality of end flaps foldably connected to a respective panel of the plurality of panels. The plurality of end flaps can include a first bottom end flap 143 foldably connected to the bottom panel 121 at respective portion of a longitudinal fold line 145, a first back end flap 147 (broadly, "first end flap") foldably connected to the back panel 123 at a respective portion of the fold line 145, and a first front end flap 149 foldably connected to the front panel 127 at a respective portion of the fold line 145.

As shown, the back end flap 147 can include a base portion 151 foldably connected to the back panel 123 at the respective portion of the fold line 145 and a distal portion or attachment portion 153 foldably connected to the base portion 151 at an oblique line of weakening/fold line 152.

Furthermore, a second bottom end flap 155 can be foldably connected to the bottom panel 121 at a respective portion of a longitudinal fold line 157, a second back end flap 159 (broadly, "second end flap") can be foldably connected to the back panel 123 at a respective portion of the fold line 157, and a second front end flap 161 foldably connected to the front panel 129 at a respective portion of the fold line 157. The back end flap 159 can include a base portion 163 foldably connected to the back panel 123 at the respective portion of the fold line 157 and a distal portion or attachment portion 165 foldably connected to the base portion 163 at an oblique line of weakening/fold line 167.

The plurality of end flaps can further comprise a first top end flap 169 (broadly, "first end flap") foldably connected to an interior edge of the top panel 131 circumscribing an opening 171 at a longitudinal line of weakening/fold line 173 and a second top end flap 175 (broadly, "second end flap") foldably connected to the top panel 131 at an opposite edge thereof at a longitudinal line of weakening/fold line 177. In this regard, the top panel 131 extends at least partially around the opening 171 and the top end flaps 169, 175 can be positioned extending into the opening 171.

Each top end flap 169, 175, as shown, can include a respective base portion 177, 179 foldably connected to the top panel 131 at the respective longitudinal fold lines 173, 177, and a respective distal portion or attachment portion 181, 183 foldably connected to the respective base portion 177, 179 at a respective oblique line of weakening/fold line 185, 187.

The blank 103 and tray 105 formed therefrom can also include locking features for at least partially maintaining an erected configuration of the tray 105. Such locking features can include one or more of locking tabs 189, 191 protruding from the respective front end flaps 149, 161 and corresponding to respective lines of weakening 193, 195 interrupting the respective fold lines 145, 157 adjacent the respective back end flaps 147, 159. In this regard, the lines of weakening 193, 195 extend along the front panel 123. As described further herein, the locking tabs 189, 191 are for being at least partially received through the lines of weakening 193, 195 when the tray 105 is formed from the blank 103.

As described herein, the engagement features of the blank 103 and the tray 105 formed therefrom can include the top panel 131. In some embodiments, the engagement features can include one or more of the flange support panels 135, 139.

As also described further herein, the reinforcement features of the blank 103 and the tray 105 can include one or more of the flange support panels 135, 139.

Figure 2:
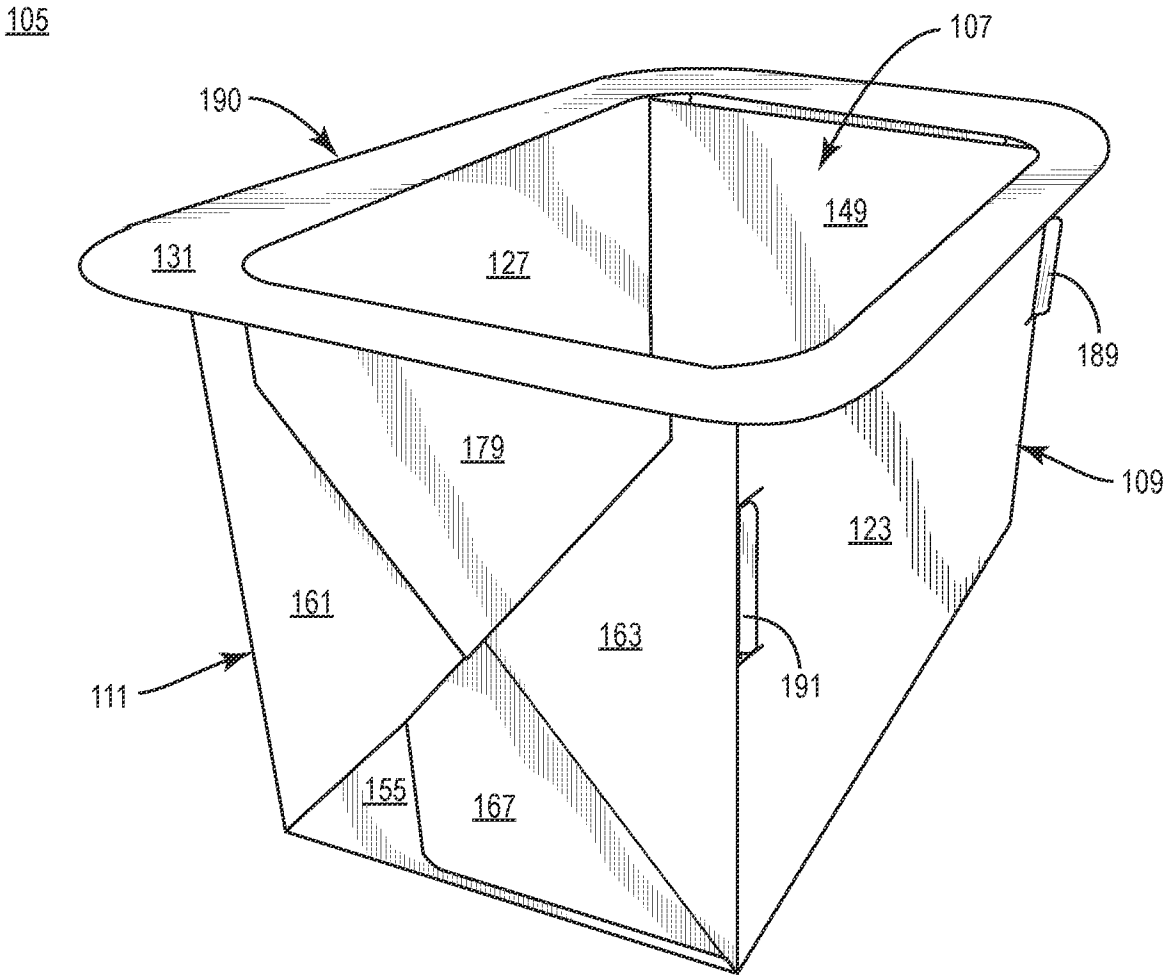
FIG. 2 is a perspective view of a tray formed from the blank of FIG. 1 according to the first exemplary embodiment of the disclosure.
Figure 3:
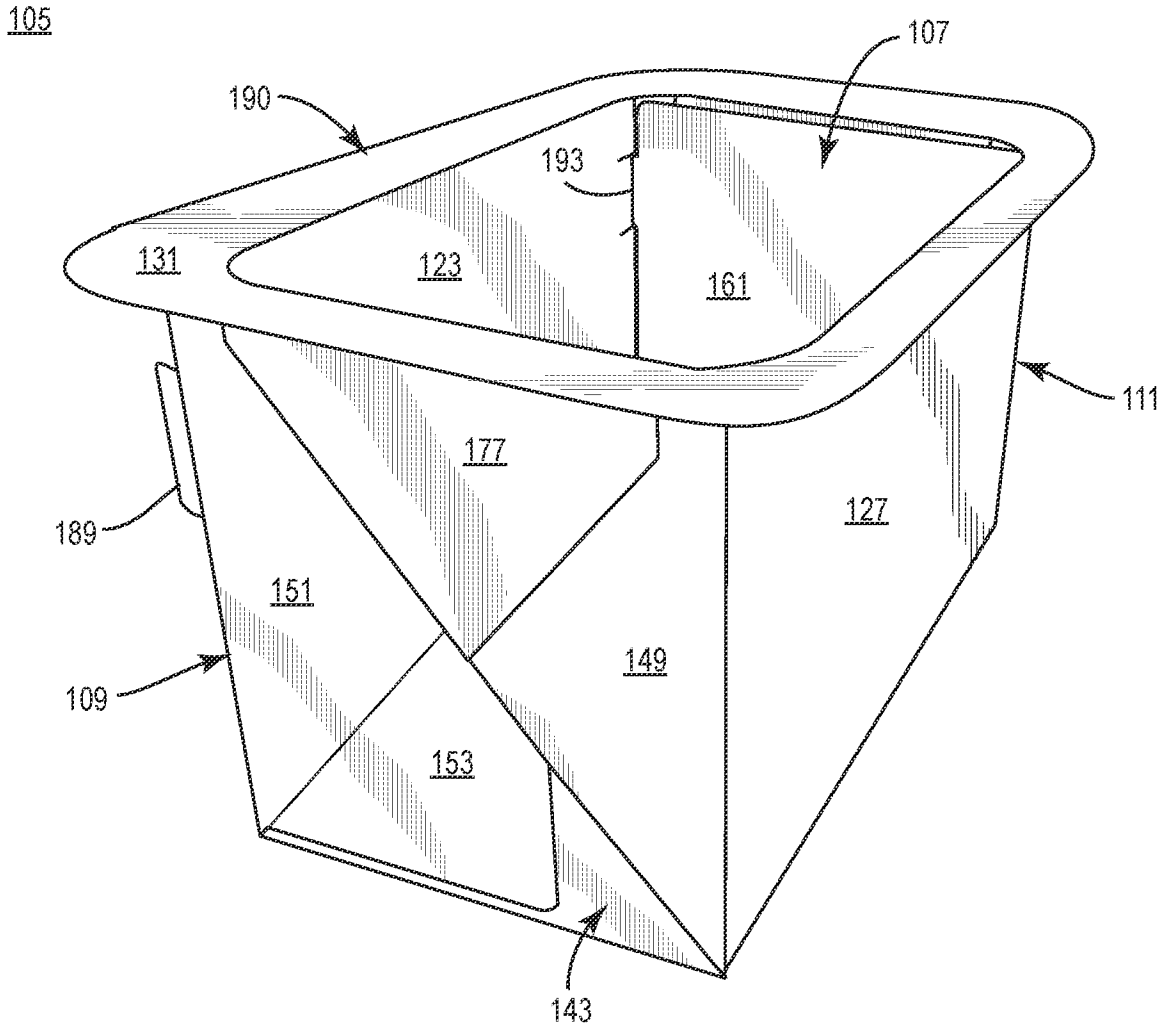
FIG. 3 is another perspective view of the tray of FIG. 2.

Referring to FIGS. 2 and 3, according to an exemplary embodiment of the disclosure, formation of the tray 105 from the blank 103 can be performed by inverting the blank 103 such that the exterior surface 101 is positioned on a supporting surface and such that an interior surface of the blank 103 can be positioned facing upwardly.

The end flaps 143, 155 can be folded at respective portions of the fold lines 145, 157 into at least partial face-to-face contact with respective portions of the bottom panel 121, the end flaps 149, 161 can be folded at respective portions of the fold line 145 into at least partial face-to-face contact with respective portions of the front panel 127, and the end flaps 147, 159 can be folded at respective portions of the fold lines 145, 157 into at least partial face-to-face contact with respective portions of the back panel 123. In the aforementioned arrangement, the end flaps 149, 161 can be positioned in at least partial overlapping relation.

Simultaneously or thereafter, the attachment portion 153 of the end flap 147 can be folded at the fold line 152 and positioned in at least partial face-to-face contact with a respective portion of the base portion 151 of the end flap 147, and the attachment portion 165 of the end flap 159 can be folded at the fold line 167 and positioned in at least partial face-to-face contact with a respective portion of the base portion 163 of the end flap 159.

The back panel 123 can be folded at the fold line 125 into at least partial face-to-face contact with the bottom panel 121, and the flange support panel 139 can be backfolded at the fold line 141 into at least partial face-to-face contact with a respective portion of the exterior surface of the back panel 123.

Simultaneously or thereafter, the top panel 131 can be folded at the fold line 137 into respective portions of the flange support panel 135 and the end flaps 149, 161. Such folding can position the end flaps 169, 175 into at least partial face-to-face contact with respective portions of the end flaps 149, 161.

The aforementioned arrangement of panels and end flaps can be at least partially maintained with one or more applications of adhesive such as glue G (FIG. 1). In particular, the interior surface of the respective attachment portions 153, 165 of the respective end flaps 147, 159 can be attached/adhered to the exterior surface of the respective end flaps 143, 155, the interior surface of the respective attachment portions 181, 183 of the respective end flaps 169, 175 can be attached/adhered to the exterior surface of the respective end flaps 149, 161, a longitudinally inner portion of the top panel 131 can be attached/adhered to the flange support panel 135, and a longitudinally outer portion of the top end panel 131 can be attached/adhered to the flange support panel 139.

Furthermore, such arrangement of the panels and flaps of the blank 103/tray 105 can be considered a collapsed configuration of the tray 105, e.g., for a space minimizing arrangement for shipping or storage.

As shown in FIGS. 2 and 3, the tray 105 can be reconfigured from the collapsed configuration to an erected configuration by positioning the front panel 127 and the back panel 123 in spaced and parallel arrangement, both panels 127, 123 generally upright relative to the bottom panel 121. The top panel 131 can also be in spaced and parallel arrangement with the bottom panel 121.

Simultaneously or thereafter, end flaps 149, 161 can be folded at respective portions of the fold lines 145, 157, e.g., away from the interior 107 of the tray 105. Such movement of the end flap 149 can cause the end flap 169 attached thereto to reconfigure such that the distal portion 181 thereof folds at the fold line 185 and into at least partial face-to-face contact with the base portion 177 thereof. This movement of the end flap 149 can also urge the end flap 143 (and, incidentally, the end flap 147 attached thereto) to fold at respective portions of the fold line 145 into a generally planar arrangement with the end flaps 149, 169. Such at least partially overlapping arrangement of the end flaps 143, 147, 149 can form a first closed end 109 of the tray 105.

Similarly, movement of the end flap 161 can cause the end flap 175 attached thereto to reconfigure such that the distal portion 183 thereof folds at the fold line 187 and into at least partial face-to-face contact with the base portion 179 thereof. This movement of the end flap 161 can also urge the end flap 155 (and, incidentally, the end flap 159 attached thereto) to fold at respective portions of the fold line 157 into a generally planar arrangement with the end flaps 161, 175. Such at least partially overlapping arrangement of the end flaps 155, 161, 163 can form a second closed end 111 of the tray 105.

Upon positioning the end flaps 149, 161 as described herein, the locking tabs 189, 191 protruding from the respective end flaps 149, 161 can be at least partially received through the respective lines of weakening 193, 195 in a locking arrangement, e.g., to maintain and/or enhance the erected configuration of the tray 105. In some embodiments, one or more portions of the respective locking tabs 189, 191 can engage one or more portions of the back panel 123 and/or respective end flaps 147, 159 adjacent the respective lines of weakening 193, 195.

The aforementioned arrangement provides the panels of the tray 105 extending at least partially around the interior 107 of the tray 105 and the plurality of end flaps overlapped to form a first closed end 109 and a second closed end 111 of the tray 105. Due to the relative attachment of longitudinally adjacent end flaps of the plurality of end flaps to one another, reconfiguration of the tray 105 from a collapsed configuration to an erected configuration can be accomplished efficiently and smoothly, for example, so as to minimize a required number of steps or associated machinery. For example, positioning the top panel 131 in generally spaced and parallel relation with respect to the bottom panel 121 can cause the aforementioned reconfiguration of end flaps to form the closed ends 109, 111 of the tray 105, e.g., so as to obviate the need to independently position the end flaps.

In this regard, the above-described arrangement of the blank 103 and tray 105 formed therefrom is such that the panels and flaps thereof are generally arranged extending in a single direction, e.g., along the longitudinal axis L1, to facilitate folding and gluing operations along a straight line to facilitate formation of the tray 105 on related forming machinery. For example, upon initial folding of the end flaps 143, 149, 151, 159, 155, 161, further folding operations are all along generally lateral lines of weakening spaced apart along the longitudinal axis L1.

It will be understood that one or more food products can be dropped, placed, or otherwise positioned in the interior 107 of the tray 105 during or subsequent to the aforementioned steps. In one embodiment, the food products can be tomatoes, though one or more of the food products can be a different food product without departing from the disclosure. The tray 105 can be provided with one or more food products as a package.

As described herein, engagement features of the tray 105 includes the top panel 131, which extends outwardly from the respective panels and closed ends 109, 111 to form a rim or flange 190 and one or more engagement surfaces for being engaged/supported by an element associated with a forming apparatus for the tray 105, for example a machine element such as a grasper, fork, pincer, rail, etc. In one embodiment, the exterior (e.g., downward facing) surface of the flange supporting panels 135, 139 can present engagement surfaces for being engaged/supported by such a machine component. In other embodiments, engagement surfaces can include any combination of one or more of the exterior, interior (e.g., upward facing), and/or side-facing surfaces of the top panel 131.

The positioning of the top panel 131 extending away from the panels of the tray 105, also presents a plurality of engagement/support surfaces for engaging/supporting a covering or lidding film, e.g., a plastic or other polymeric film, or other covering structure. In one embodiment, the lidding film can be provided as a polymeric layer that at least partially deforms in the presence of a heat source, e.g., a heat sealable film. The lidding film can thus be positioned extending across the opening 171 and in contact with one or more surfaces of the top panel 131 to cover the interior 107 of the tray 105 and maintain one or more conditions of the food products held therein, e.g., freshness, ripeness, moisture content, etc. It will be understood that the lidding film can minimize, inhibit, and/or prevent the passage of one or more materials into the interior 107 of the tray 105, for example, condensation or other moisture, insects or other pests, dirt, debris, etc. In one embodiment, the tray 105 can be provided together with the lidding film and one or more food products as a package.

Furthermore, the reinforcement features of the tray 105 can include at least the arrangement of one or both of the flange supporting panels 135, 139 in at least partial face-to-face contact with respective portions of the underside of the top panel 131/flange 190, the engagement of which can minimize, inhibit, prevent, and/or otherwise resist bending, bowing, flexing, buckling, curling, deflection, and/or other deformation of the flange 190. In this regard, forces exerted on the flange 190 via tension applied through a covering or lidding film disposed thereon can minimize, inhibit, and/or prevent deformation of the flange 190, e.g., to avoid undesirable product aesthetics, to avoid at least partial disengagement of the lidding film with the flange 190, to maintain a generally planar configuration of the flange 190 during use, storage, transport, etc. In some embodiments, the locking features of the tray 105 can additionally or alternatively be considered reinforcement features of the tray 105.

It will be understood that one or more of the panels, flaps, and associated features of the blank 103/tray 105 can have a different arrangement or configuration without departing from the disclosure. In one embodiment, one or more portions of the tray 105 can be separated at respective lines of weakening to facilitate access to the interior 107 of the tray 105.

Figure 4:
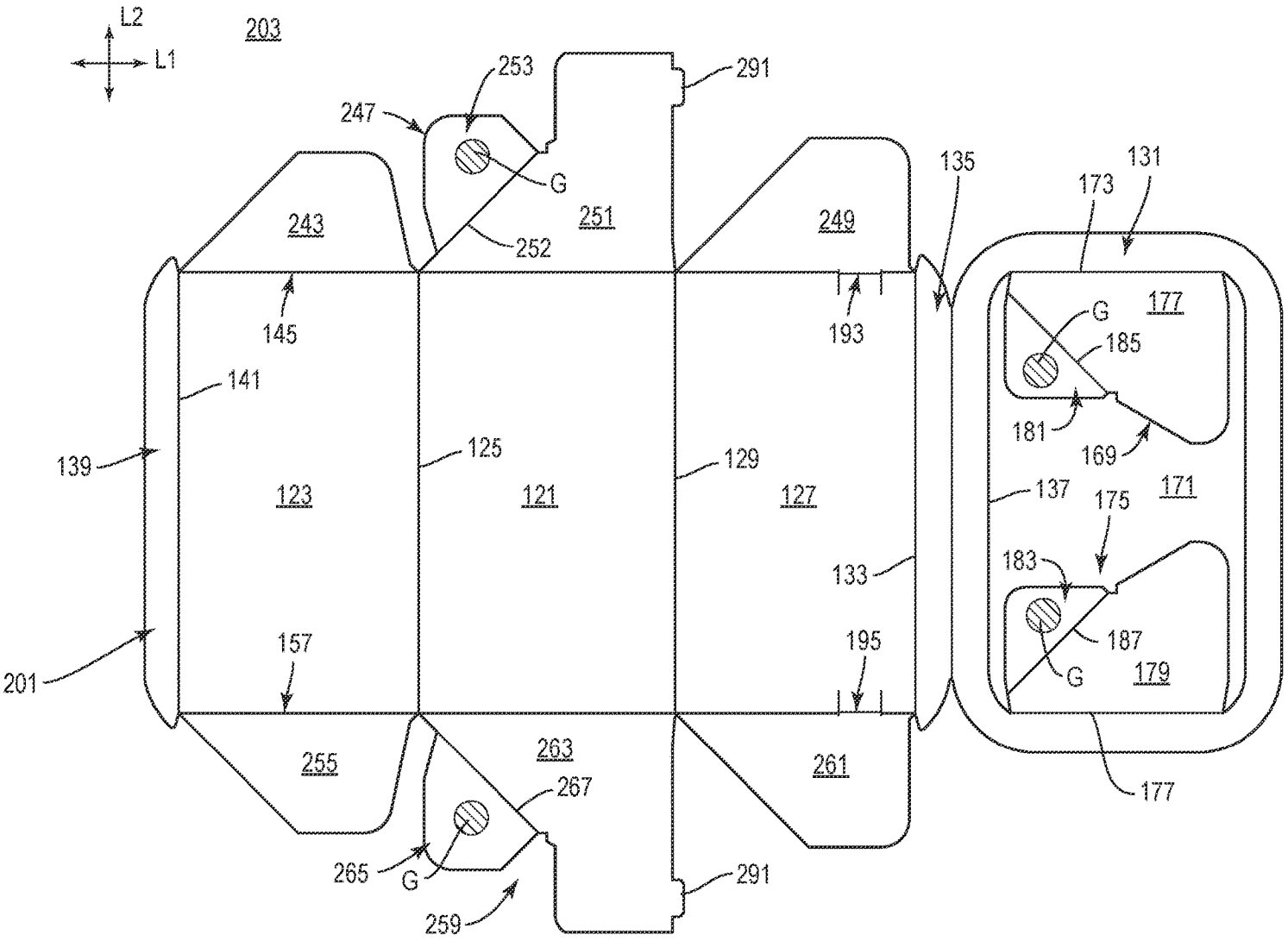
FIG. 4 is a plan view of an exterior surface of a blank used to form a tray according to a second exemplary embodiment of the disclosure.

Turning to FIG. 4, the exterior surface 201 of a blank 203 for forming a tray 205 according to a second exemplary embodiment of the disclosure is illustrated. The blank 203 and tray 205 formed therefrom can include one or more components that are the same or similar to those of the blank 103 and tray 105 of the first exemplary embodiment, and like or similar features are designated with like or similar reference numerals.

As shown, the blank 203 has the longitudinal axis L1, the lateral axis L2, the panels 121, 123, 127, 131, 135, 139 and associated features, and the end flaps 169, 175 and associated features. However, the blank 203 and the tray 205 formed therefrom can have a different configuration and arrangement of one or more end flaps foldably connected to a respective panel of the plurality of panels.

In the illustrated embodiment, a back end flap 243 can be foldably connected to the back panel 123 at a respective portion of the fold line 145, a bottom end flap 247 (broadly, "first end flap") can be foldably connected to the bottom panel 121 at a respective portion of the fold line 145, and a front end flap 249 can be foldably connected to the front panel 127 at a respective portion of the fold line 149.

The bottom end flap 247, as shown, can include a base portion 251 foldably connected to the bottom panel 121 at the respective portion of the fold line 145, and a distal portion or attachment portion 253 foldably connected to the base portion 251 at an oblique line of weakening or fold line 252. As also shown, a locking tab 289 can be positioned extending from the attachment portion 253 of the end flap 247.

Similarly, a back end flap 255 can be foldably connected to the back panel 123 at a respective portion of the fold line 157, a bottom end flap 259 (broadly, "second end flap") can be foldably connected to the bottom panel 121 at a respective portion of the fold line 157, and a front end flap 261 can be foldably connected to the front panel 127 at a respective portion of the fold line 157. The bottom end flap 259 can include a base portion 263 foldably connected to the bottom panel 121 at the respective portion of the fold line 157, and a distal portion or attachment portion 265 foldably connected to the base portion 263 at an oblique line of weakening or fold line 267, with a locking tab 291 positioned extending from the distal portion 263 of the end flap 259.

In addition, the line of weakening 193 can be positioned interrupting the fold line 145 adjacent the end flap 249 for at least partially receiving the locking tab 289 when the tray 205 is formed from the blank 203, and the line of weakening 195 can be positioned interrupting the fold line 157 adjacent the end flap 261 for at least partially receiving the locking tab 291 when the tray 205 is formed from the blank 203. In this regard, the lines of weakening 193, 195 can at least partially extend along the back panel 127.

Figure 5:
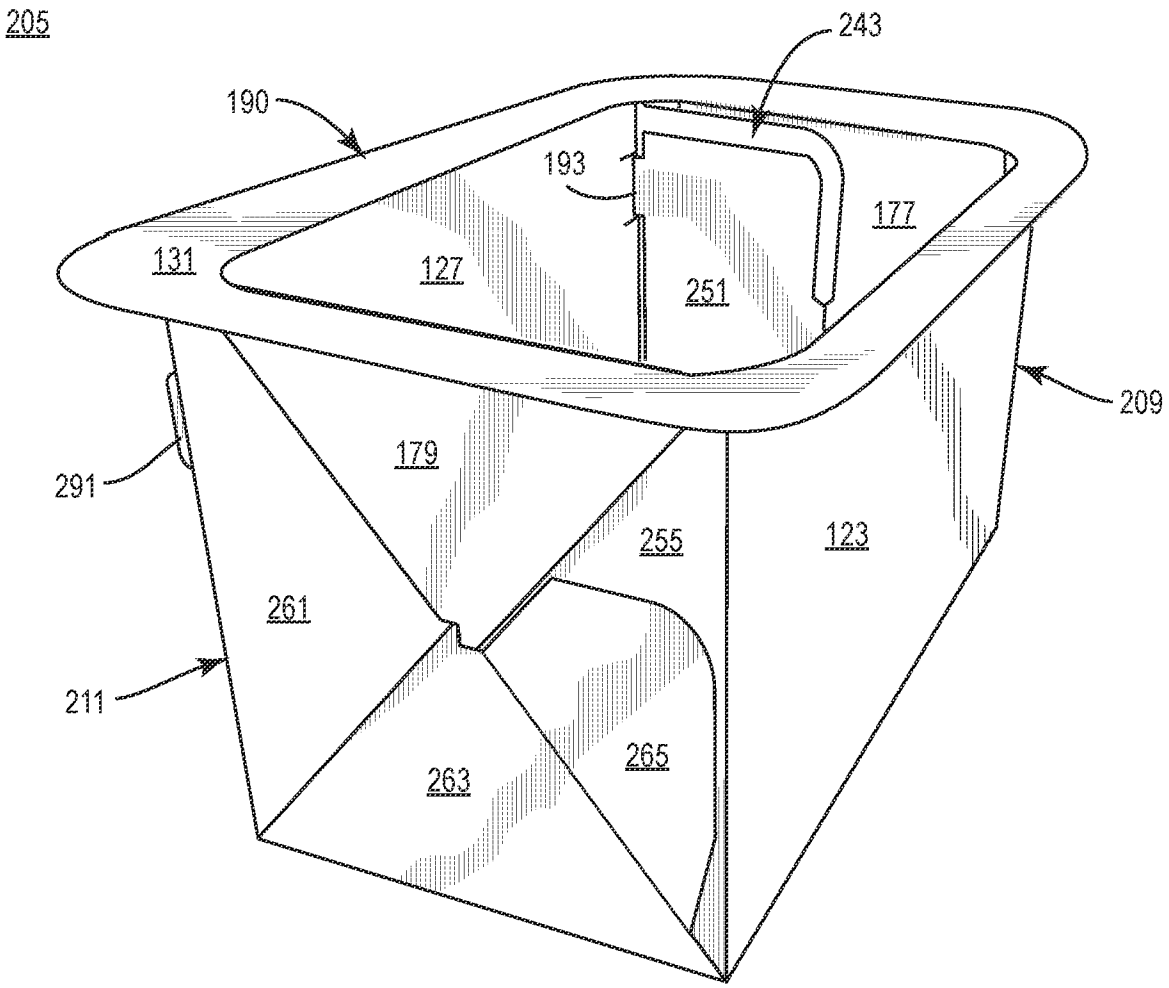
FIG. 5 is a perspective view of a tray formed from the blank of FIG. 4 according to the second exemplary embodiment of the disclosure.
Figure 6:
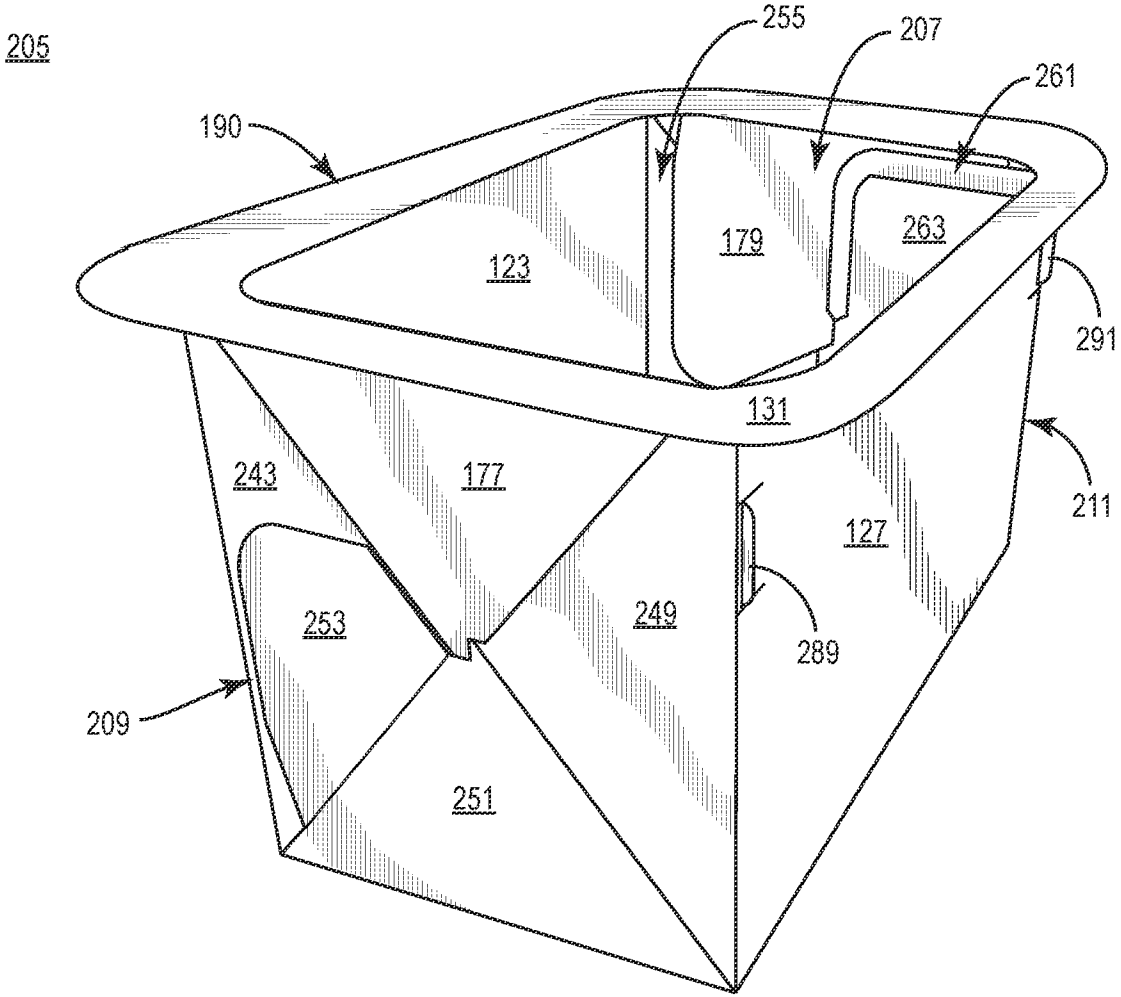
FIG. 6 is another perspective view of the tray of FIG. 5.

Referring to FIGS. 5 and 6, according to one embodiment of the disclosure, formation of the tray 205 from the blank 203 can be performed in a manner similar to that described above with regard to the formation of the tray 105 from the blank 103, e.g., by positioning the front panel 127 and the back panel 123 in spaced and parallel arrangement, both panels 127, 123 generally upright relative to the bottom panel 121. The top panel 131 can also be in spaced and parallel arrangement with the bottom panel 121

However, after inverting the blank 203 such that the exterior surface 201 is positioned on a supporting surface and such that the interior surface of the blank 203 is positioned facing upwardly, formation of closed ends 209, 211 of the tray 205 can include folding the end flap 243 at the respective portion of the fold line 145 into at least partial face-to-face contact with a respective portion of the back panel 123, folding the end flap 247 at the respective portion of the fold line 145 into at least partial face-to-face contact with a respective portion of the bottom panel 121, folding the end flap 249 at the respective portion of the fold line 145 into at least partial face-to-face contact with a respective portion of the front panel 127, folding the end flap 255 at the respective portion of the fold line 157 into at least partial face-to-face contact with a respective portion of the back panel 123, folding the end flap 259 at the respective portion of the fold line 157 into at least partial face-to-face contact with a respective portion of the bottom panel 121, and folding the end flap 261 at the respective portion of the fold line 157 into at least partial face-to-face contact with a respective portion of the front panel 123.

Further, formation of the closed ends 209, 211 of the tray 205 can include folding the attachment portion 253 of the end flap 247 at the fold line 252 into at least partial face-to-face contact with the base portion 251 thereof and folding the attachment portion 265 of the end flap 259 at the fold line 267 into at least partial face-to-face contact with the base portion 263 thereof.

The aforementioned arrangement of panels and end flaps can be at least partially maintained with one or more applications of adhesive such as glue G. In particular, the interior surface of the respective distal portions 253, 265 of the respective end flaps 247, 259 can be attached/adhered to the respective end flaps 243, 255, the interior surface of the respective distal portions 181, 183 of the respective end flaps 169, 175 can be attached/adhered to the respective interior surfaces of the end flaps 249, 261, a longitudinally inner portion of the top panel 131 can be attached/adhered to the flange support panel 135, and a longitudinally outer portion of the top end panel 131 can be attached/adhered to the flange support panel 139.

As the tray 205 is formed from the blank 203, the end flaps 169, 177 can be folded downwardly at the respective fold lines 173, 177 into the interior 207 of the tray 205. Such movement of the end flaps 169, 177 can cause the respective end flaps 249, 261 attached thereto to fold at respective portions of the respective fold lines 145, 157 away from the interior 207 of the tray 205. This movement can also cause the end flaps 247, 259 to fold upwardly at respective portions of the respective fold lines 145, 157 to cause the respective end flaps 243, 255 attached thereto to fold at respective portions of the respective fold lines 145, 157 away from the interior 207 of the tray 205.

In this regard, the end flaps 243, 247, 249, 169 can be positioned in a generally planar and at least partially overlapping arrangement to form a first closed end 209 of the tray 205 and the end flaps 255, 263, 261, 175 can be positioned in a generally planar and at least partially overlapping arrangement to form a second closed end 211 of the tray 205.

Upon positioning the end flaps 247, 265 as described herein, the locking tabs 289, 291 protruding therefrom can be at least partially received through the respective lines of weakening 193, 195 in a locking arrangement, e.g., to maintain and/or enhance the erected configuration of the tray 205. In some embodiments, one or more portions of the respective locking tabs 289, 291 can engage one or more portions of the front panel 127 and/or respective end flaps 249, 261 adjacent the respective lines of weakening 193, 195.

The erected configuration of the tray 205 can provide advantages similar to those described above with regard to the tray 105. Further, the tray 205 can be provided with one or more food products and/or a lidding film in the manner described above with regard to the tray 105.

Figure 7:
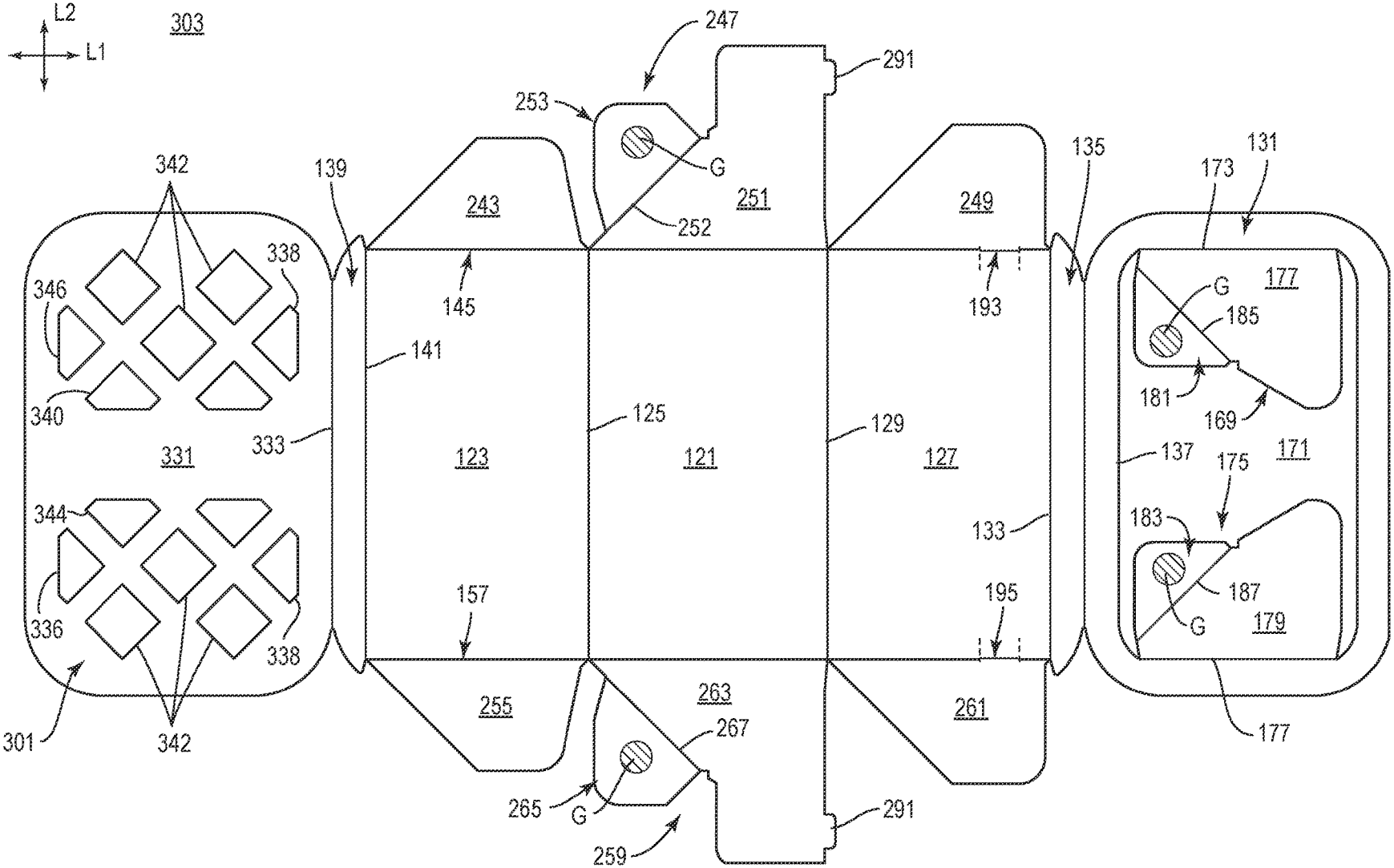
FIG. 7 is a plan view of an exterior surface of a blank used to form a tray according to a third exemplary embodiment of the disclosure.

Turning to FIG. 7, the exterior surface 301 of a blank 303 for forming a tray 305 according to a third exemplary embodiment of the disclosure is illustrated. The blank 303 and tray 305 formed therefrom can include one or more components that are the same or similar to those of the blanks 103, 203 and trays 105, 205 described above, and like or similar features are designated with like or similar reference numerals.

As shown, the blank 303 can be generally similar to the blank 203 of the second exemplary embodiment, but can further include a top panel 331 (broadly, "second top panel") foldably connected to the flange supporting panel 139 at a lateral fold line 333. In this regard, the top panel 131 can be a first top panel of the blank 303/tray 305, and the top panel 331 can be a second top panel of the blank 303/tray 305.

The top panel 331 can include a plurality of product visibility features, e.g., openings 336, 338, 340, 342, 344, as described further herein.

Figure 8:
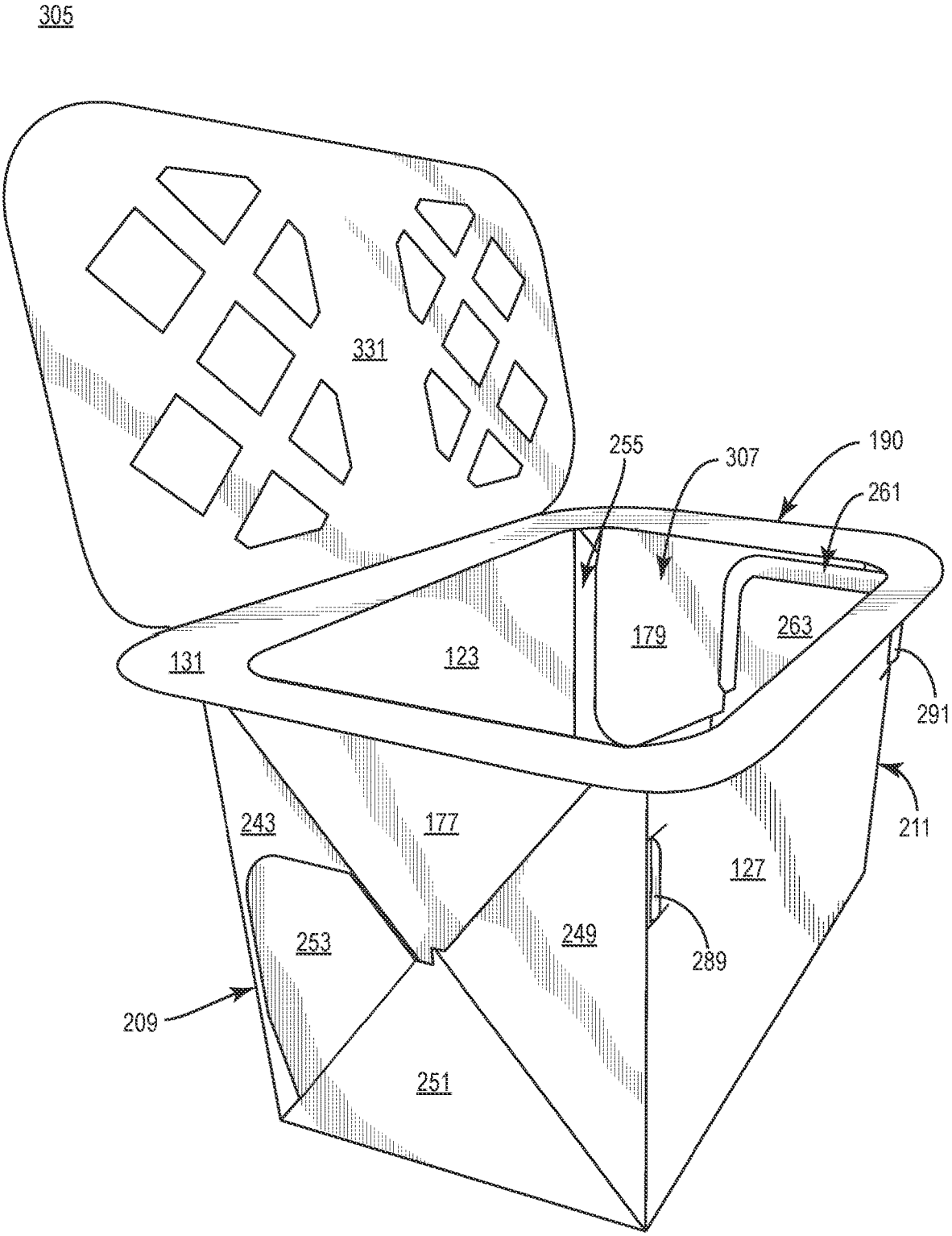
FIG. 8 is a perspective view of a tray formed from the blank of FIG. 7 according to the third exemplary embodiment of the disclosure in an open configuration.
Figure 9:
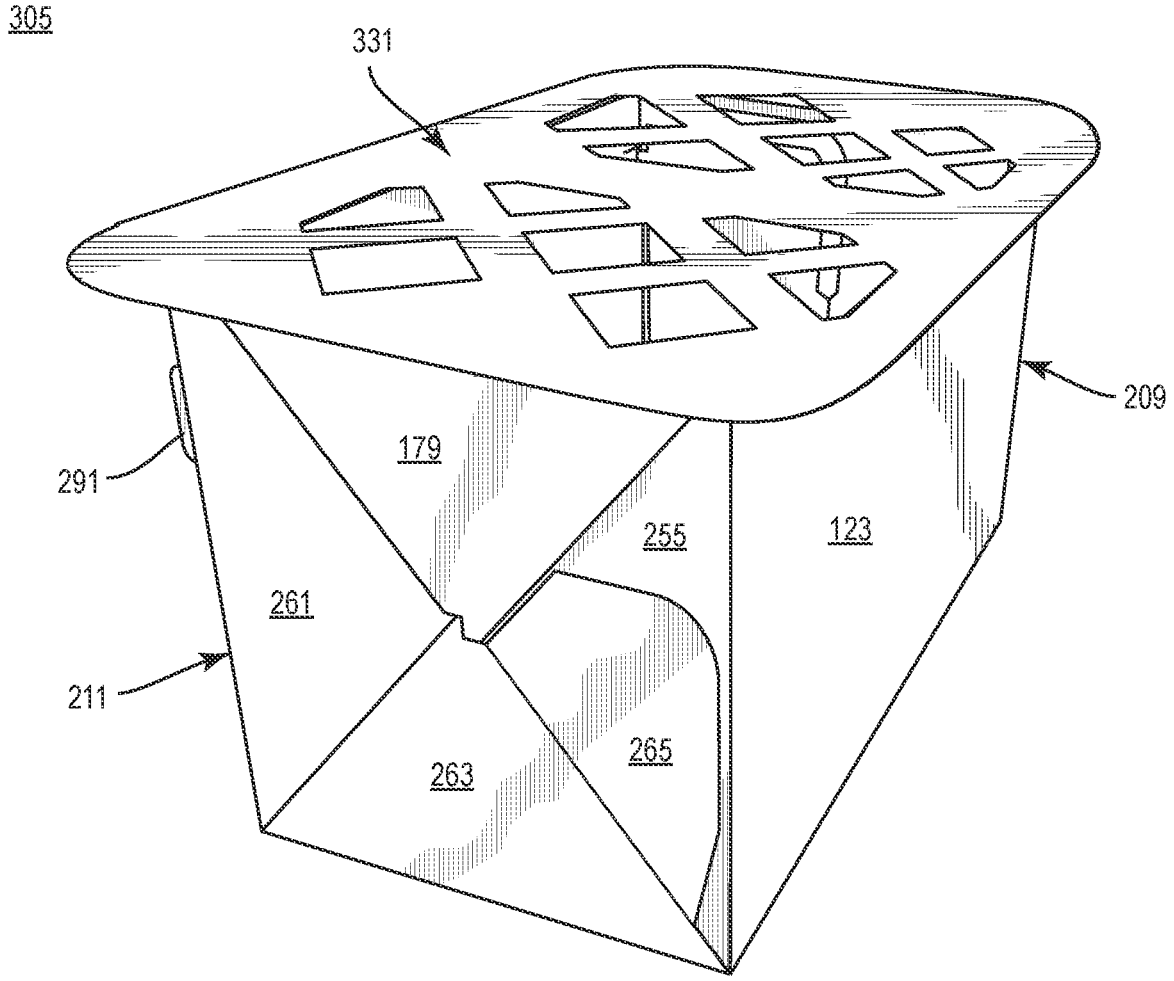
FIG. 9 is a perspective view of the tray formed from the blank of FIG. 7 according to the third exemplary embodiment of the disclosure in a closed configuration.

Referring additionally to FIGS. 8-9, the tray 305 can be formed from the blank 303 in a manner similar to that described above with regard to the formation of the tray 205 from the blank 203. However, as a final step, the second top panel 331 can be folded downwardly at the fold line 333 into at least partial face-to-face contact with the top panel 131. In this regard, the second top panel 331 can be positioned extending over the opening 171 in the top panel 131.

Owing to the product visibility features in the top panel 331, the arrangement of the top panels 131, 331 provides for product visibility, e.g., such that one or more food products in the interior 307 of the tray 305 can be viewed through the openings 336, 338, 340, 342, 344. Furthermore, the portions of the top panel 331 surrounding the openings 336, 338, 340, 342, 344 can provide an at least partial barrier to entry into the opening 171, for example, to minimize, inhibit, and/or prevent debris or other unwanted material from entering the interior 307 of the tray 305.

A closed configuration of the tray 305/top panel 331 can be provided when the top panel 331 is in a closed position overlying at least partially overlying the top panel 131 to at least partially restrict access to the interior 307 of the tray 105. In some embodiments, the top panel 331 can be positioned in at least partial face-to-face contact with the top panel 131 in the closed position thereof to form the closed configuration of the tray 305. When it is desired to access one or more food products in the interior 307 of the tray 305, the top panel 331 can be folded upwardly at the fold line 333 and raised away from the top panel 131 into an open position to provide an open configuration of the tray 305/top panel 331.

In some embodiments, the need for a lidding film over the top panel 131 can be obviated by the presence of the top panel 331. In some embodiments, a lidding film can be applied to the top panel 131 as described above, and the top panel 331 can overlie the lidding film and the top panel 131. In some embodiments, a lidding film can be applied to the top panel 331.

In this regard, the tray 305 can provide advantages similar to those described above with regard to the trays 105, 205.

Furthermore, the arrangement of the top panel 331 over the top panel 131 can reinforce the flange 190 in when the top panel 331 is in the closed configuration. For example, the at least partial face-to-face contact of the top panels 331, 131 can provide an extra ply of material to minimize, inhibit, prevent, and/or otherwise resist bending, bowing, flexing, buckling, curling, deflection, and/or other deformation of the flange 190.

Figure 10:
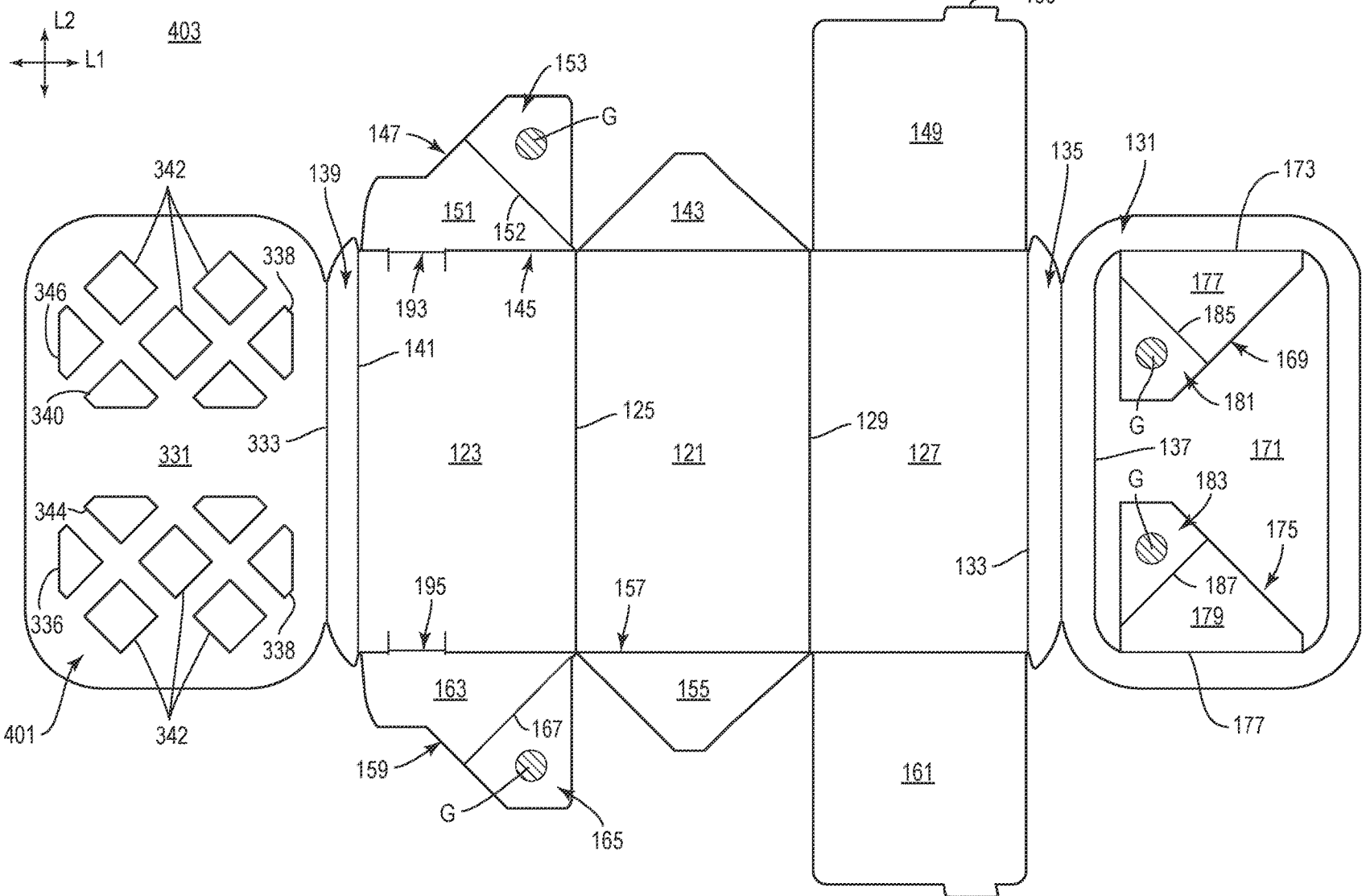
FIG. 10 is a plan view of an exterior surface of a blank used to form a tray according to a fourth exemplary embodiment of the disclosure.

Turning to FIG. 10, the exterior surface 401 of a blank 403 for forming a tray 405 according to a fourth exemplary embodiment of the disclosure is illustrated. The blank 403 and tray 405 formed therefrom can include one or more components that are the same or similar to those of the blanks 103, 203, 303 and trays 105, 205, 305 described above, and like or similar features are designated with like or similar reference numerals.

As shown, the blank 403 can be generally similar to the blank 103 of the first exemplary embodiment, but can further include the top panel 331 of the second exemplary embodiment foldably connected to the flange supporting panel 139 at the lateral fold line 133.

Figure 11:
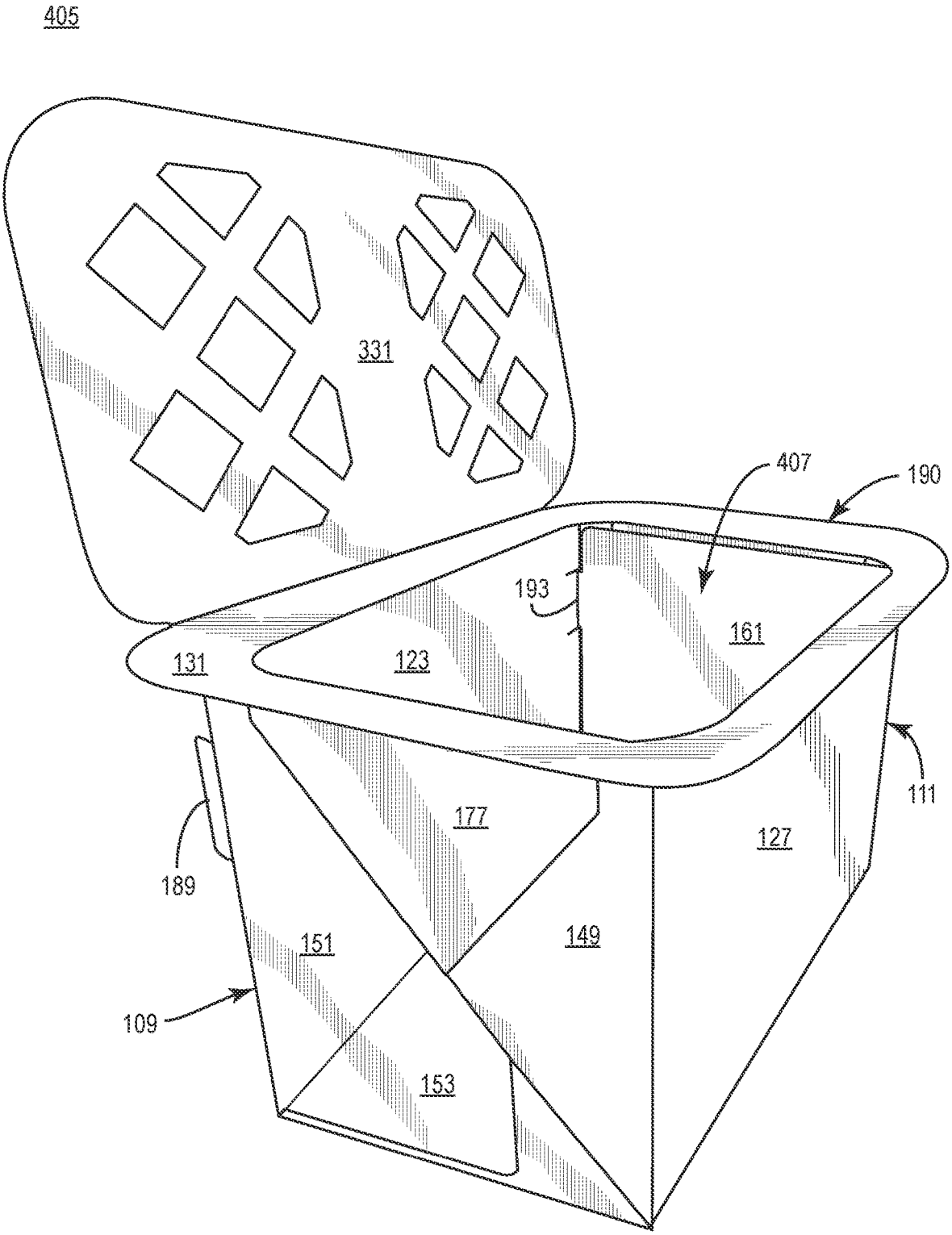
FIG. 11 is a perspective view of a tray formed from the blank of FIG. 10 according to the fourth exemplary embodiment of the disclosure in an open configuration.
Figure 12:
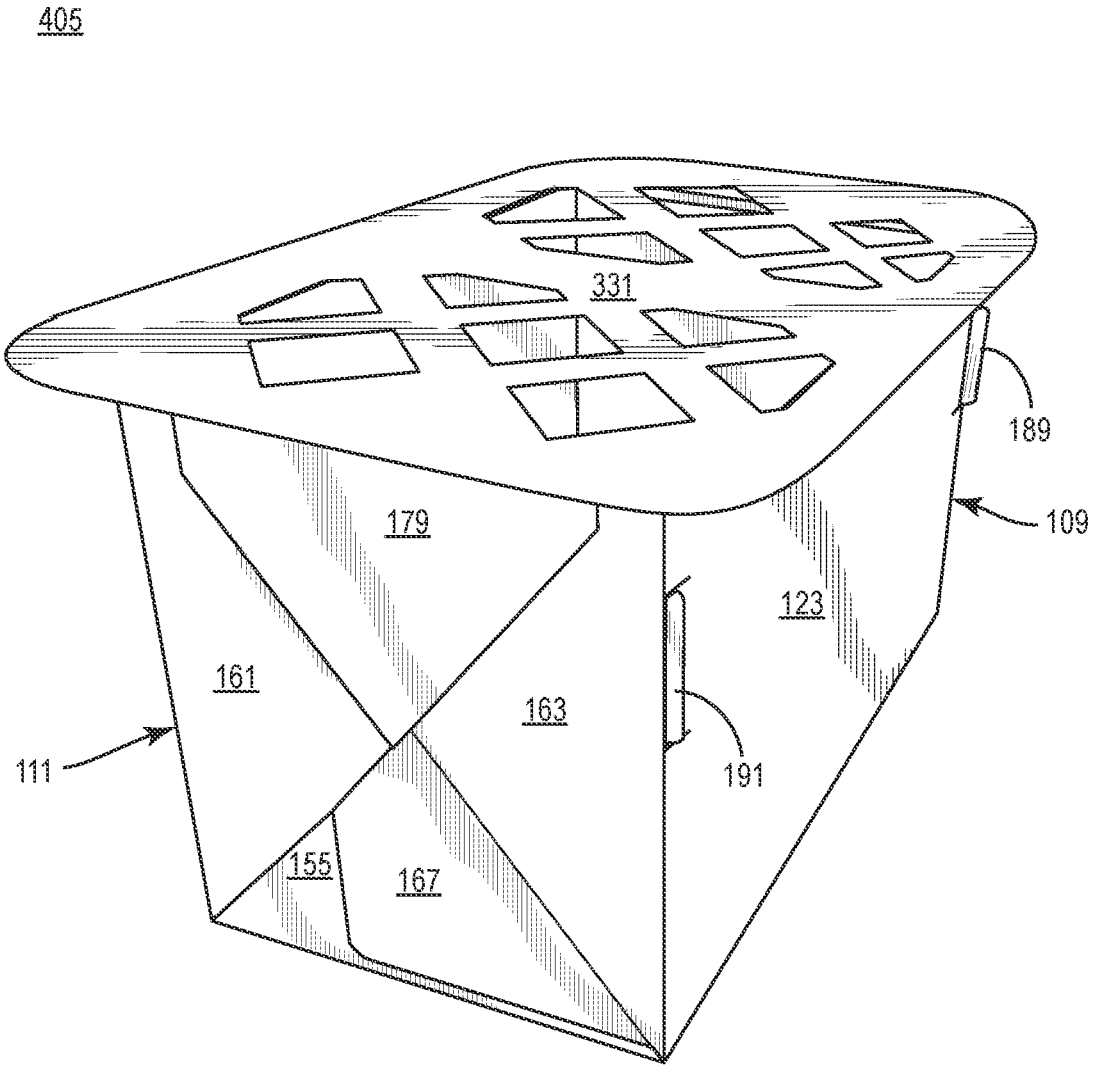
FIG. 12 is a perspective view of the tray formed from the blank of FIG. 10 according to the fourth exemplary embodiment of the disclosure in a closed configuration.

Referring additionally to FIGS. 11-12, the tray 405 can be formed from the blank 403 in a manner similar to that described above with regard to the formation of the tray 105 from the blank 103, with the added step of folding the second top panel 331 can be folded downwardly at the fold line 333 to provide the closed configuration of the tray 405/closed position of the top panel 331 as described above.

In this regard, the tray 405 can provide advantages similar to those described above with regard to the trays 105, 205, 305 described above. Further, the tray 405 can be provided with one or more food products and/or a lidding film in the manner described above with regard to the trays 105, 205, 305 described above.

Figure 13:
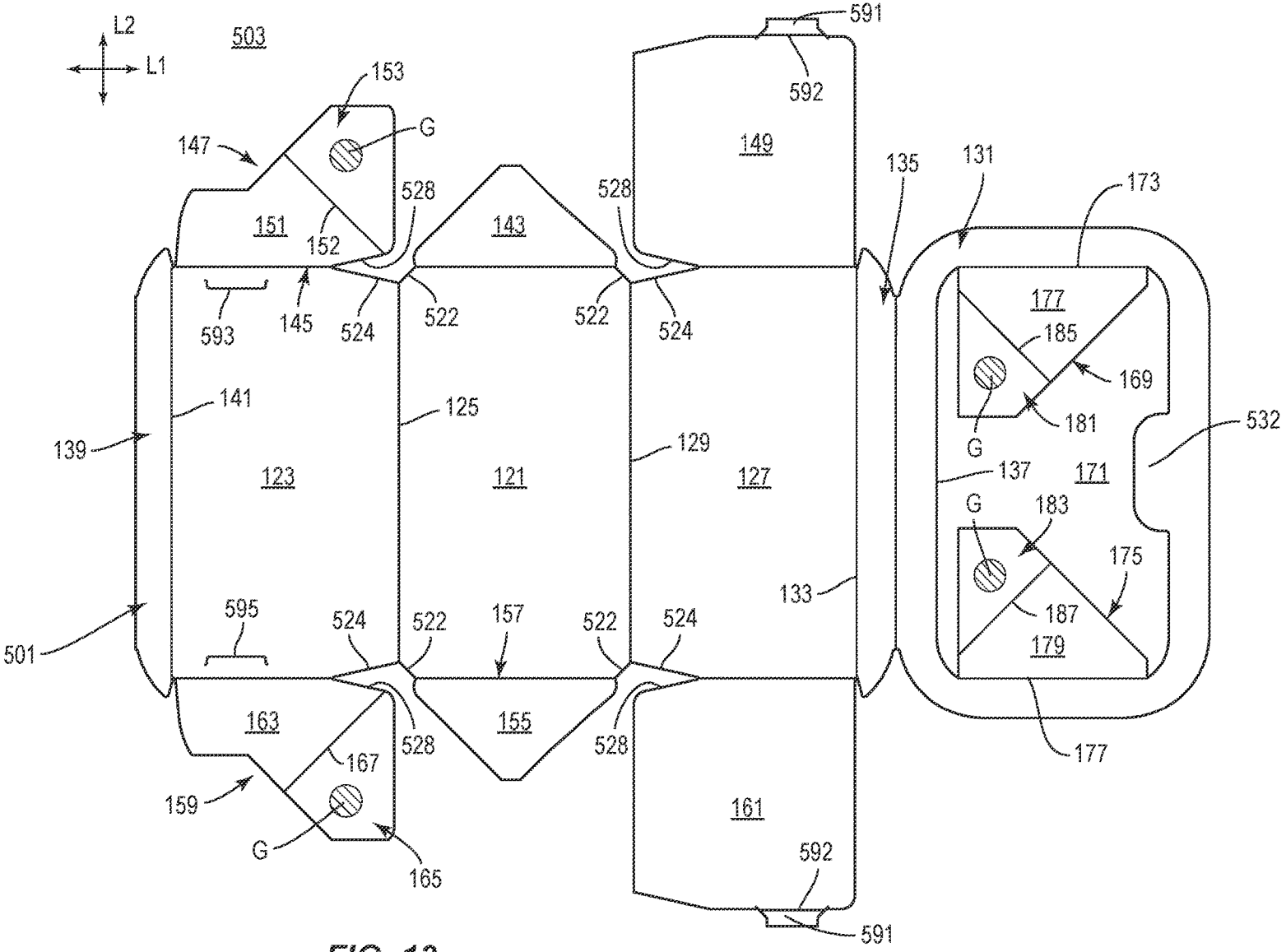
FIG. 13 is a plan view of an exterior surface of a blank used to form a tray according to a fifth exemplary embodiment of the disclosure.

Turning to FIG. 13, the exterior surface 501 of a blank 503 for forming a tray 505 according to a fifth exemplary embodiment of the disclosure is illustrated. The blank 503 and tray 505 formed therefrom can include one or more components that are the same or similar to those of the blanks 103, 203, 303, 403 and trays 105, 205, 305, 405 described above, and like or similar features are designated with like or similar reference numerals.

As shown, the blank 503 can be generally similar to the blank 103 of the first exemplary embodiment, but the locking features of the blank 503/tray 505 can include locking tabs 591 foldably connected to the respective end flaps 149, 161 at respective longitudinal lines of weakening 592, and positioned for receipt in respective locking openings formed by respective cuts 593 in the back panel 123. As shown, the cuts 593 can have one or more of straight, curved, and/or angled portions.

As also shown, the top panel 131 of the blank 503/tray 505 can include an engagement tab 532 protruding inwardly into the opening 171. As described above, the flange 190 of the tray 505 can be configured to engage/support a covering or lidding film, and the engagement tab 532 can provide additional surface area/supporting structure for engaging and supporting such covering or film. In this regard, in some embodiments, the top panel 131 can be provided with an increased or optimized surface area/width, etc., to facilitate engaging/supporting a covering or lidding film. Such increased size of the top panel 131/flange 190 can also facilitate enhanced engagement with a machine element or other component of a system associated with the formation, loading, and/or packaging of the tray 505.

Still referring to FIG. 13, the bottom panel 121 can include a plurality of chamfered/angled/beveled corner edges 522 intersecting respective portions of the fold lines 125, 129, 152, 257, the back panel 123 can include a respective pair of chamfered/angled/beveled corner edges 524 intersecting endpoints of the fold line 125, and the front panel 127 can include a respective pair of chamfered/angled/beveled corner edges 526 intersecting endpoints of the fold line 129. Furthermore, the end flaps 147, 149, 159, 161 can include a respective chamfered/angled/beveled corner edge 528 intersecting the respective edges 522 of the bottom panel 121.

Figure 14:
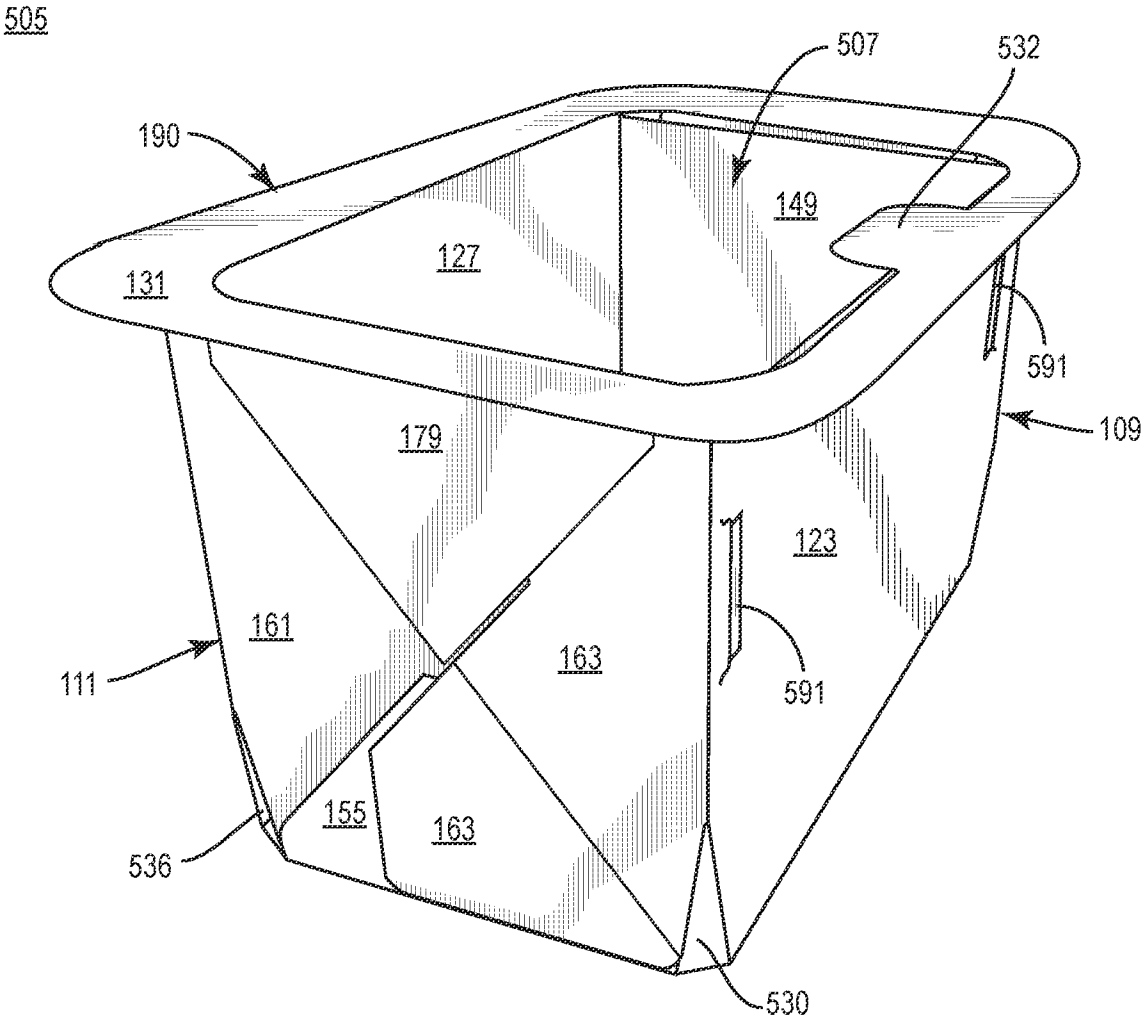
FIG. 14 is a perspective view of a tray formed from the blank of FIG. 13 according to the fifth exemplary embodiment of the disclosure.
Figure 15:
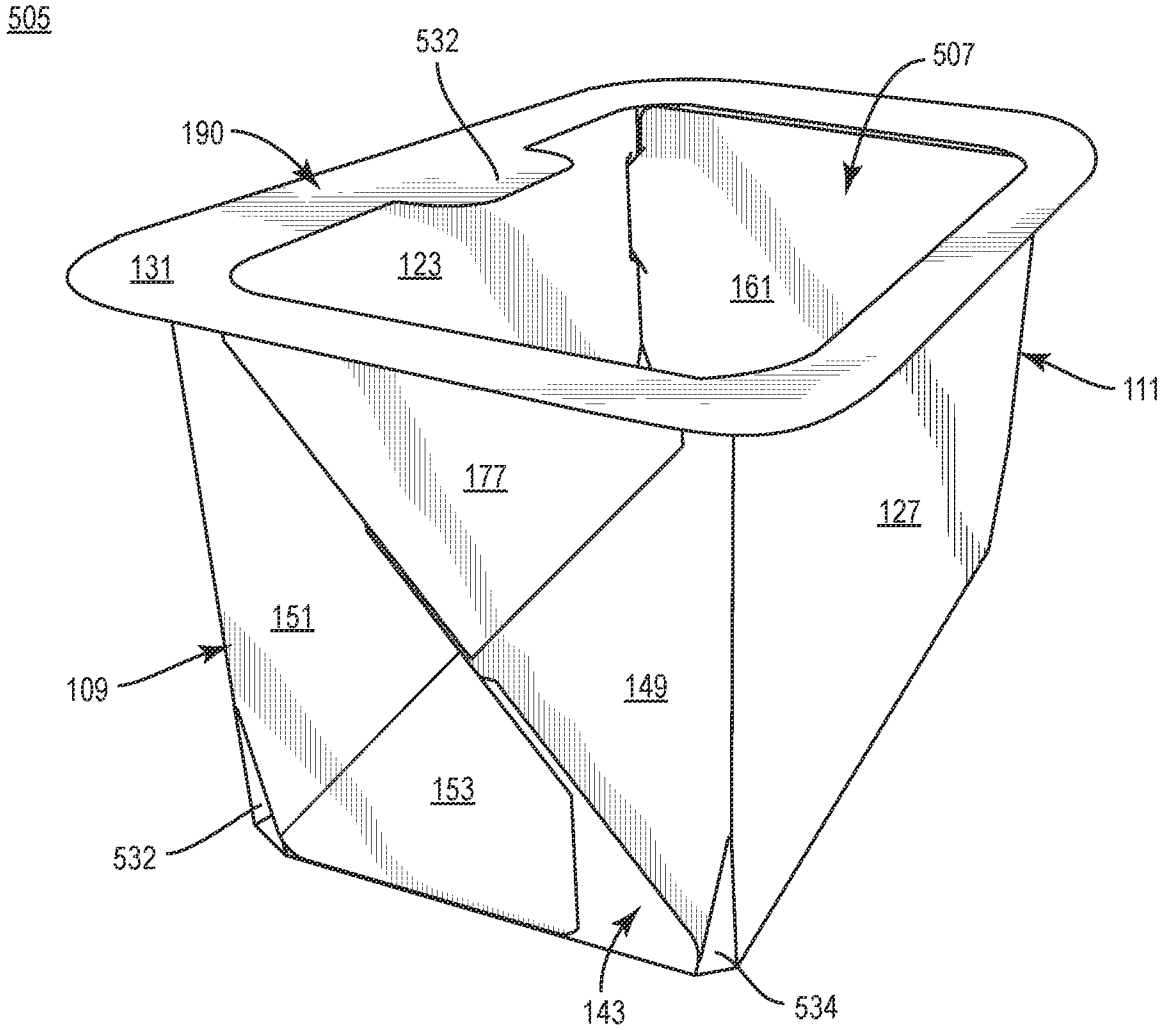
FIG. 15 is another perspective view of the tray of FIG. 14.

Referring additionally to FIGS. 14 and 15, the tray 505 can be formed from the blank 503 in a manner similar to that described above with regard to the formation of the tray 105 from the blank 103, with the added step of at least partially inserting the respective locking tabs 591 through the respective locking openings formed by the respective cuts 593 in the back panel 123. Such insertion of the tabs 591 through the respective openings formed by the cuts 593 can include at least partial folding of one or both of the tabs 591 relative to the respective flaps 149, 161 at the respective lines of weakening 592. Such engagement of the tabs 591 and openings formed by the respective cuts 593 can facilitate formation and maintenance of the tray 505 in the erected configuration.

Furthermore, the arrangement of the edges 522, 524, 526, 528 of the respective panels and flaps of the tray 505 is such that, upon formation of the tray 505, respective bottom corner openings 530, 532, 534, 536 are provided in the tray 505 extending away from the bottom panel 121, for example, for drainage, ventilation, to reduce material, for additional product visibility, etc. In some embodiments, one or more of the corner openings 530, 532, 524, 536 can be positioned and arranged to at least partially receive/engage one or more components of a machine or other component of a system associated with the formation, loading, and/or packaging of the tray 505.

In this regard, the tray 505 can provide advantages similar to those described above with regard to the trays 105, 205, 305, 405 described above. Further, the tray 505 can be provided with one or more food products and/or a lidding film in the manner described above with regard to the trays 105, 205, 305, 405.

Figure 16:
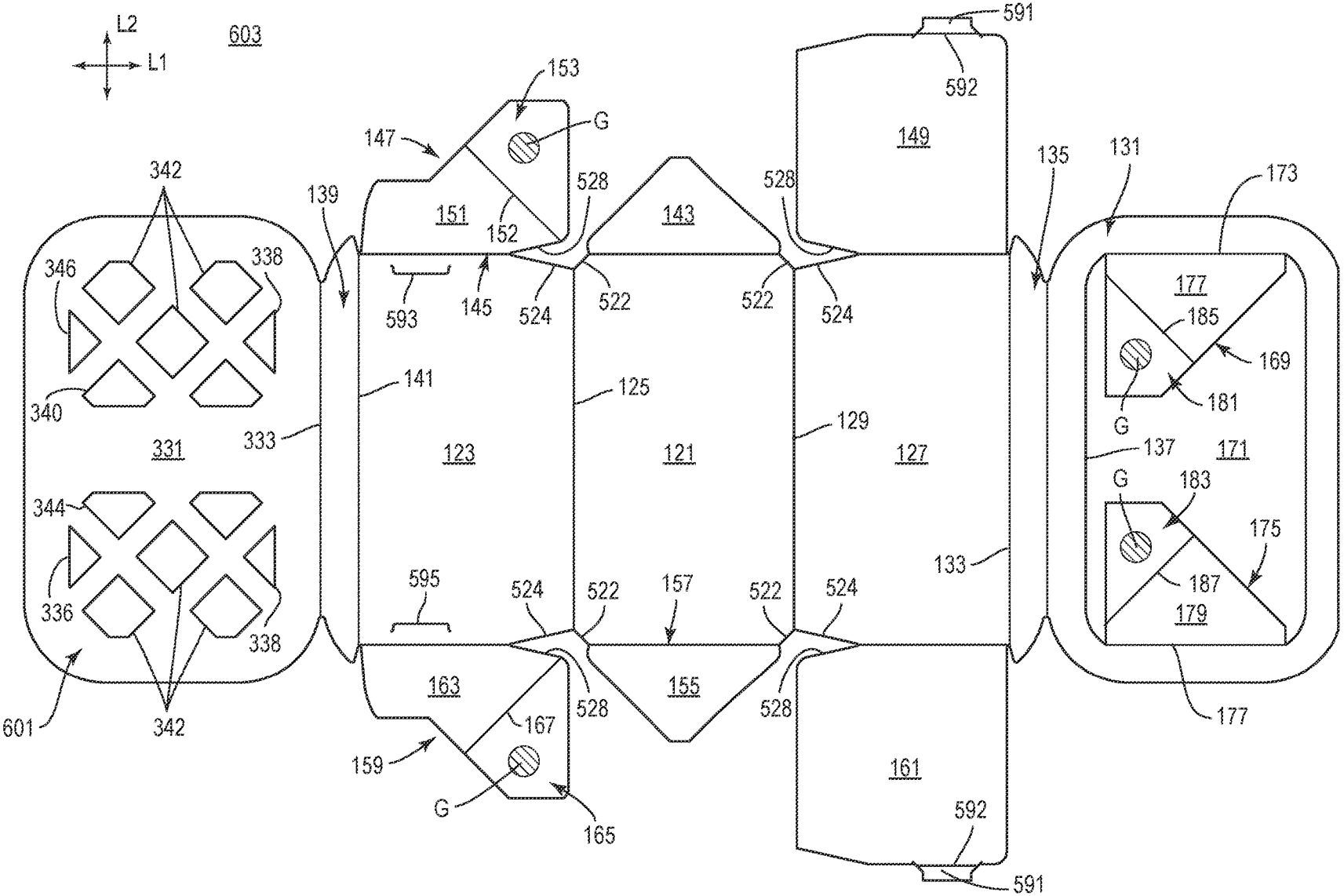
FIG. 16 is a plan view of an exterior surface of a blank used to form a tray according to a sixth exemplary embodiment of the disclosure.

Turning to FIG. 16, the exterior surface 601 of a blank 603 for forming a tray 605 according to a sixth exemplary embodiment of the disclosure is illustrated. The blank 603 and tray 605 formed therefrom can include one or more components that are the same or similar to those of the blanks 103, 203, 303, 403, 503 and trays 105, 205, 305, 405, 505 described above, and like or similar features are designated with like or similar reference numerals.

As shown, the blank 603 can be generally similar to the blank 503 of the fifth exemplary embodiment, but the second top panel 331 can additionally be foldably attached to the flange supporting panel 139 at the fold line 333. As also shown, the top panel 131 can be devoid of the engagement tab 532, though the engagement tab 532 can be provided without departing from the disclosure.

Figure 17:
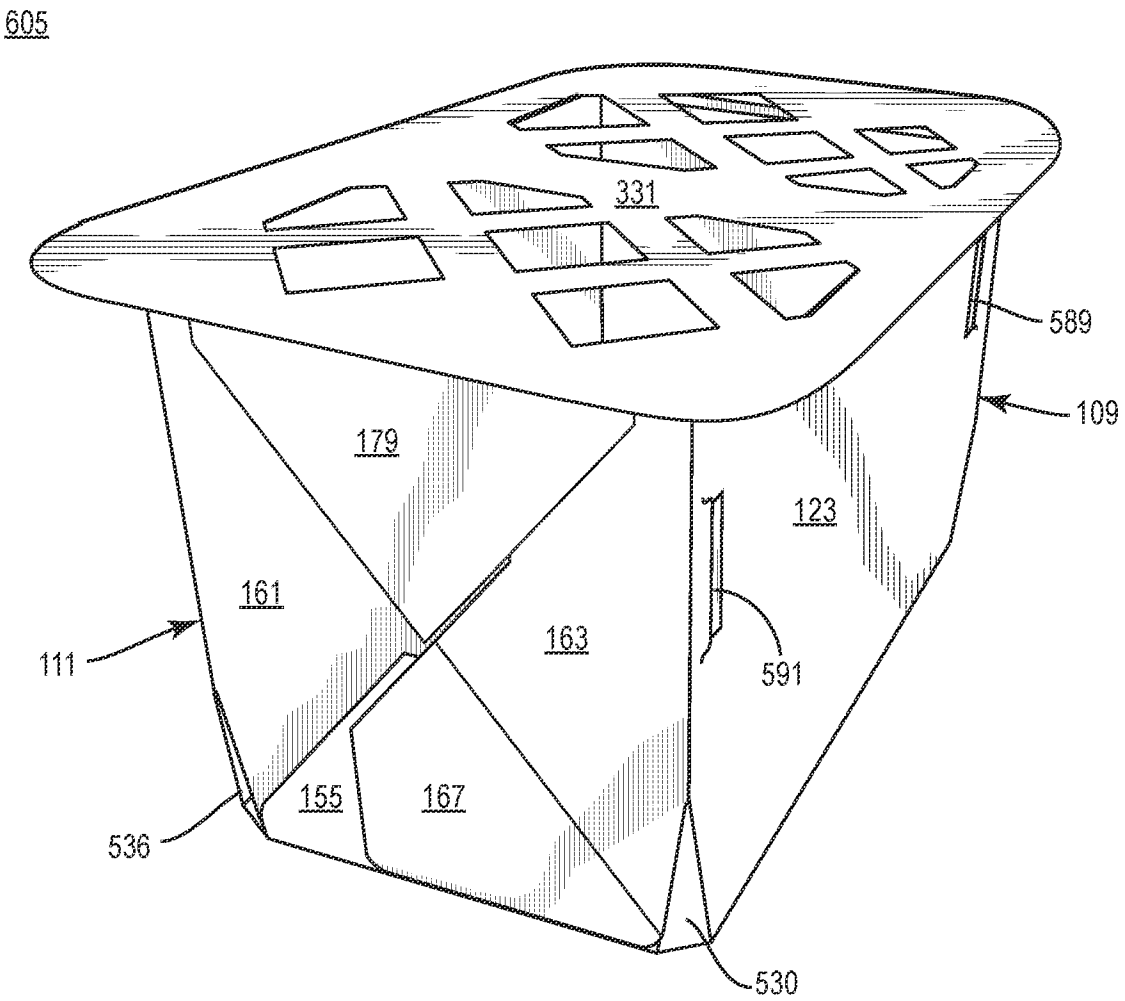
FIG. 17 is a plan view of an exterior surface of a blank used to form a tray according to a sixth exemplary embodiment of the disclosure in an open configuration.
Figure 18:
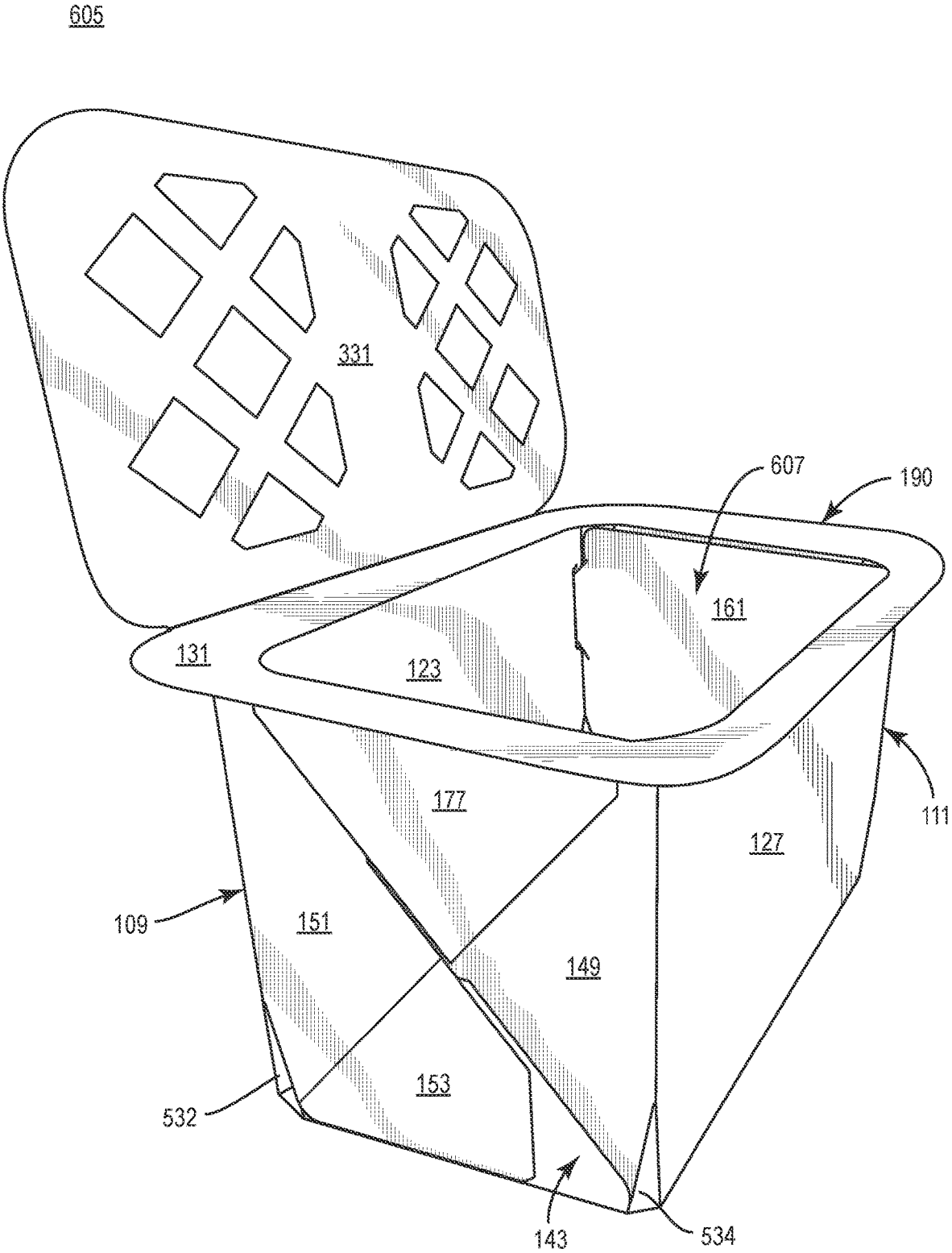
FIG. 18 is a perspective view of a tray formed from the blank of FIG. 17 according to the sixth exemplary embodiment of the disclosure in a closed configuration.

Referring additionally to FIGS. 17 and 18, the tray 605 can be formed from the blank 603 in a manner similar to that described above with regard to the formation of the tray 505 from the blank 503, with the added step of at least partially folding the second top panel 331 downwardly onto the first top panel 131 at the fold line 333 to form the closed position thereof/closed configuration of the tray 605 as described above.

In this regard, the tray 605 can provide advantages similar to those described above with regard to the trays 105, 205, 305, 405, 505 described above. Further, the tray 605 can be provided with one or more food products and/or a lidding film in the manner described above with regard to the trays 105, 205, 305, 405, 505.

Figure 19:
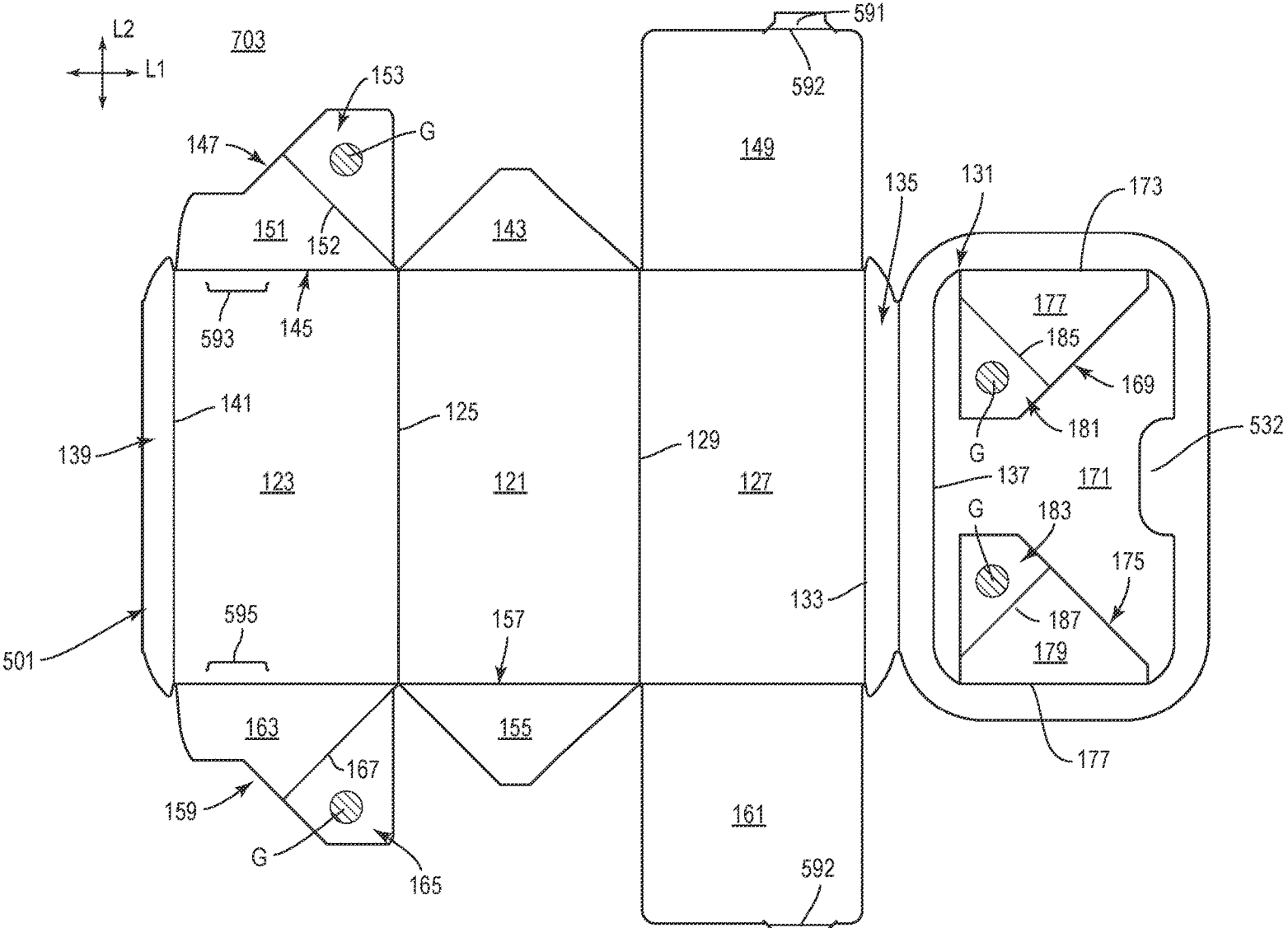
FIG. 19 is a plan view of an exterior surface of a blank used to form a tray according to a seventh exemplary embodiment of the disclosure.

Turning to FIG. 19, the exterior surface 701 of a blank 703 for forming a tray 705 according to a seventh exemplary embodiment of the disclosure is illustrated. The blank 703 and tray 705 formed therefrom can include one or more components that are the same or similar to those of the blanks 103, 203, 303, 403, 503, 603 and trays 105, 205, 305, 405, 505, 605 described above, and like or similar features are designated with like or similar reference numerals.

Figure 20:
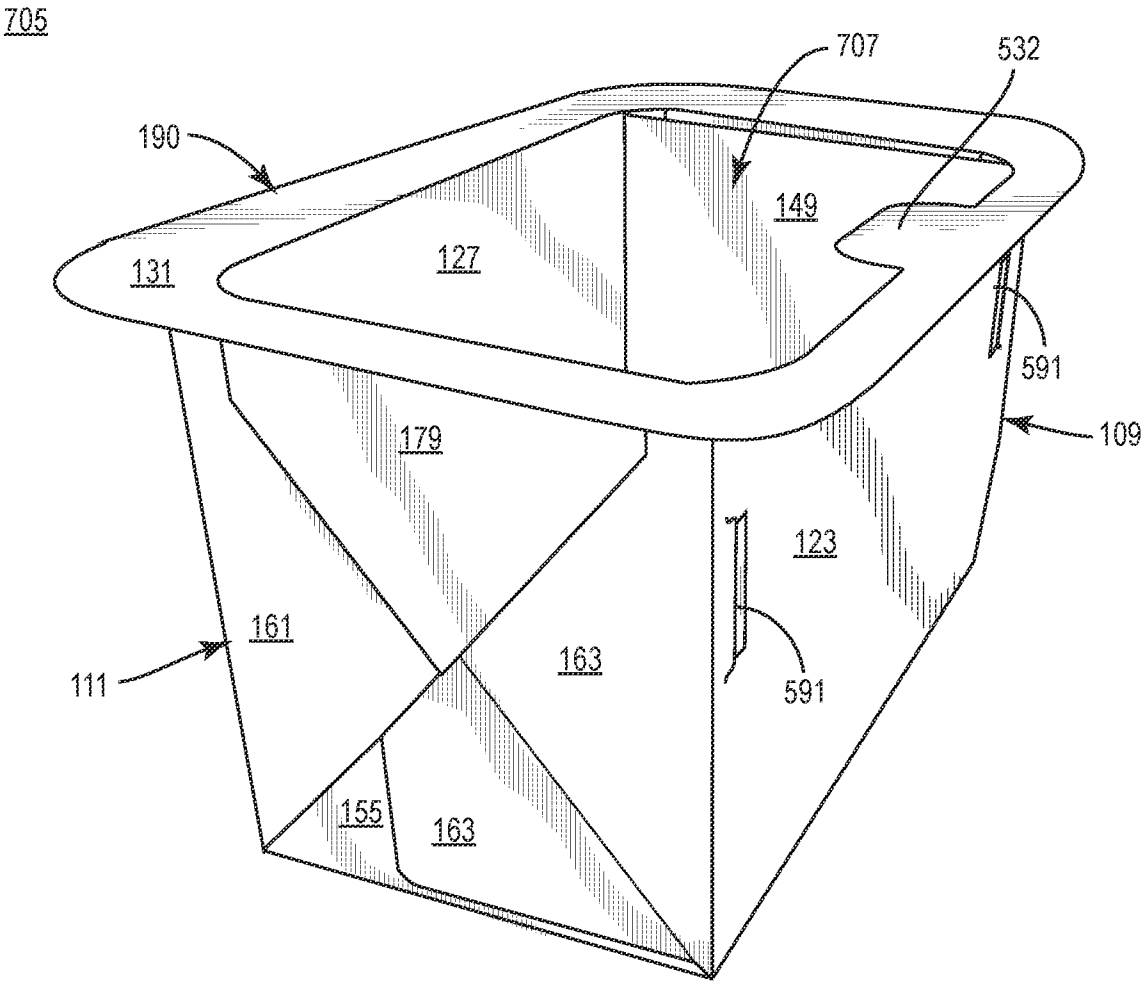
FIG. 20 is a perspective view of a tray formed from the blank of FIG. 21 according to the seventh exemplary embodiment of the disclosure.

Referring additionally to FIG. 20, the tray 705 can be formed from the blank 703 in a manner similar to that described above with regard to the formation of the tray 505 from the blank 503, though without forming the respective corner openings 530, 532, 534, 536. It will be understood that the tray 705 can include one or more of the corner openings 530, 532, 534, 536 without departing from the disclosure In this regard, the tray 705 can provide advantages similar to those described above with regard to the trays 105, 205, 305, 405, 505, 605 described above. Further, the tray 205 can be provided with one or more food products and/or a lidding film in the manner described above with regard to the tray 105.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the trays, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure tray panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding at least one food product, the tray comprising:

a plurality of panels extending at least partially around an interior of the tray and comprising a bottom panel, a front panel foldably connected to the bottom panel, a back panel foldably connected to the bottom panel, and a top panel foldably connected to one of the front panel and the back panel;

a plurality of end flaps foldably connected to a respective panel of the plurality of panels, the plurality of end flaps at least partially overlapped to form at least one closed end of the tray; and wherein the top panel includes a flange having a base region proximate the front panel and proximate the back panel, the flange extending outwardly from the front panel and from the back panel to a distal region.

2. The tray of claim 1, wherein at least one end flap of the plurality of end flaps comprises a base portion foldably connected to a respective panel of the plurality of panels and an attachment portion foldably connected to the base portion.

3. The tray of claim 2, wherein the attachment portion is positioned in at least partial face-to-face contact with an adjacent end flap of the plurality of end flaps.

4. The tray of claim 3, wherein the at least one end flap of the plurality of end flaps is foldably connected to one of the front panel and the back panel.

5. The tray of claim 3, wherein the at least one end flap of the plurality of end flaps is foldably connected to the bottom panel.

6. The tray of claim 3, wherein the at least one end flap of the plurality of end flaps is foldably connected to the top panel.

7. The tray of claim 3, wherein the at least one closed end of the tray is a first closed end of the tray and the plurality of end flaps are at least partially overlapped to form a second closed end of the tray.

8. The tray of claim 7, wherein the at least one end flap of the plurality of end flaps is a first end flap at least partially forming the first closed end of the tray, and the plurality of end flaps comprises a second end flap at least partially forming the second end of the tray, the second end flap comprises a base portion foldably connected to a respective panel of the plurality of panels and an attachment portion foldably connected to the base portion of the second end flap.

9. The tray of claim 3, wherein the top panel is a first top panel, and the plurality of panels further comprises a second top panel foldably connected to one of the front panel and the back panel.

10. The tray of claim 9, wherein the second top panel is reconfigurable between a closed position, in which the second top panel is positioned overlying the interior of the tray, and an open position, in which the second top panel is raised away from the interior of the tray.

11. The tray of claim 10, wherein the second top panel is for being positioned in at least partial face-to-face contact with the first top panel in the closed position.

12. The tray of claim 3, wherein the top panel extends at least partially around an opening and comprises an engagement tab extending into the opening.

13. The tray of claim 3, wherein the tray further comprises locking features, the locking features comprising a locking tab extending from a respective end flap of the plurality of end flaps and at least partially received through a line of weakening extending at least partially along a respective panel of the plurality of panels.

14. The tray of claim 13, wherein the locking tab is foldably connected to a respective end flap of the plurality of end flaps.

15. The tray of claim 3, wherein the plurality of panels further comprises at least one flange support panel foldably connected to a respective panel of the plurality of panels.

16. The tray of claim 15, wherein the at least one flange support panel is positioned in at least partial face-to-face contact with the flange.

17. A blank for forming a tray for holding at least one food product, the blank comprising:

a plurality of panels for extending at least partially around an interior of the tray formed from the blank and comprising a bottom panel, a front panel foldably connected to the bottom panel, a back panel foldably connected to the bottom panel, and a top panel foldably connected to one of the front panel and the back panel;

a plurality of end flaps foldably connected to a respective panel of the plurality of panels, the plurality of end flaps for being at least partially overlapped to form at least one closed end of the tray formed from the blank, the top panel for forming a flange extending substantially parallel to the bottom panel.

18. The blank of claim 17, wherein at least one end flap of the plurality of end flaps comprises a base portion foldably connected to a respective panel of the plurality of panels and an attachment portion foldably connected to the base portion.

19. The blank of claim 18, wherein the attachment portion is for being positioned in at least partial face-to-face contact with an adjacent end flap of the plurality of end flaps when the tray is formed from the blank.

20. The blank of claim 19, wherein the at least one end flap of the plurality of end flaps is foldably connected to one of the front panel and the back panel.

21. The blank of claim 19, wherein the at least one end flap of the plurality of end flaps is foldably connected to the bottom panel.

22. The blank of claim 19, wherein the at least one end flap of the plurality of end flaps is foldably connected to the top panel.

23. The blank of claim 19, wherein the at least one closed end of the tray formed from the blank is a first closed end of the tray formed from the blank and the plurality of end flaps are for being at least partially overlapped to form a second closed end of the tray formed from the blank.

24. The blank of claim 23, wherein the at least one end flap of the plurality of end flaps is a first end flap for at least partially forming the first closed end of the tray formed from the blank, and the plurality of end flaps comprises a second end flap for at least partially forming the second end of the tray formed from the blank, the second end flap comprises a base portion foldably connected to a respective panel of the plurality of panels and an attachment portion foldably connected to the base portion of the second end flap.

25. The blank of claim 19, wherein the top panel is a first top panel, and the plurality of panels further comprises a second top panel foldably connected to one of the front panel and the back panel.

26. The blank of claim 19, wherein the top panel extends at least partially around an opening and comprises an engagement tab extending into the opening.

27. The blank of claim 19, wherein the tray further comprises locking features, the locking features comprising a locking tab extending from a respective end flap of the plurality of end flaps for being at least partially received through a line of weakening extending at least partially along a respective panel of the plurality of panels when the tray is formed from the blank.

28. The blank of claim 27, wherein the locking tab is foldably connected to a respective end flap of the plurality of end flaps.

29. The blank of claim 19, wherein the plurality of panels further comprises at least one flange support panel foldably connected to a respective panel of the plurality of panels.

* * * * *